US005590612A

United States Patent [19]

Brewer et al.

[11] Patent Number: 5,590,612

[45] Date of Patent: Jan. 7, 1997

[54] BAG MAKING MACHINE

[76] Inventors: Scott A. Brewer, 43029 Weyand Ct., Lancaster, Calif. 93534; David E. Frye, 25464 Via Adorna, Valencia, Calif. 91355

[21] Appl. No.: 509,710

[22] Filed: Jul. 31, 1995

[51] Int. Cl.[6] ..... D05B 13/00

[52] U.S. Cl. ..... 112/10; 112/475.08; 112/470.07; 493/466

[58] Field of Search ..... 493/235, 254, 493/437, 444, 445, 466; 112/10, 470.07, 475.08

[56] References Cited

U.S. PATENT DOCUMENTS

| | | | |
|---|---|---|---|
| 2,940,404 | 6/1960 | Damon | 112/470.07 |
| 3,339,506 | 9/1967 | McGregor | 112/10 |
| 4,214,541 | 7/1980 | Zeigler, Jr. et al. | 112/10 X |
| 4,428,315 | 1/1984 | Keeton | 112/470.07 X |
| 4,621,585 | 11/1986 | Ball et al. | 112/10 |

*Primary Examiner*—Paul C. Lewis
*Attorney, Agent, or Firm*—Wagner & Middlebrook

[57] ABSTRACT

A machine and process for producing bags from roll stock of bag material are disclosed. The machine includes four subassemblies, a folding and cutting subassembly, a transport and first sewing subassembly and a second transport and sewing subassembly and a stacking subassembly. The folding and cutting subassembly, preferably includes a drum or reel with a plurality of peripheral clamps which are successively opened to receive the bag material and a blade positioned to force the bag material into an open clamp to define a fold. The adjacent closed clamp holding folded bag material tensions the bag material. A cutter severs adjacent folds between the adjacent clamps. Transfer and transport means are present to advance the folded cut bag blank past two sewing machines and then to the stacker subassembly. The process of this invention includes the steps of grasping the end of a continuous strip of bag material, deflecting a portion to define a fold, clamping the fold and transferring it to an adjacent station, repeating the folding and clamping operation to tension the material between folds, cutting the folds between adjacent tensioned regions to provide folded cut bag blanks. Next, the folded cut bag blanks are transferred to two successive sewing operations to sew one side and an end to complete a bag. Next, optionally, the bags may be stacked for subsequent transfer or use.

25 Claims, 24 Drawing Sheets

FIG. 20
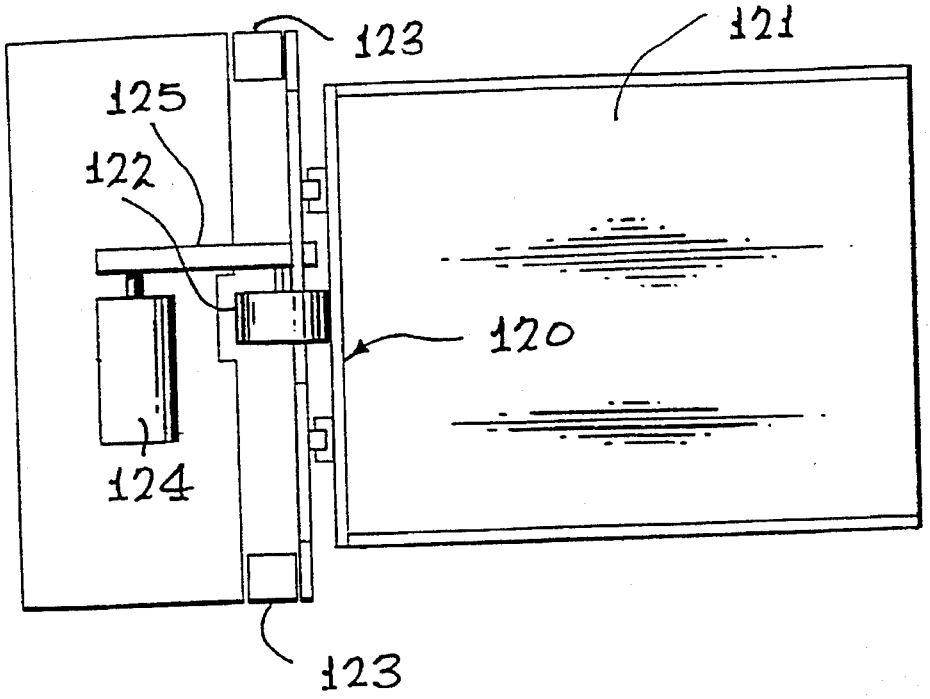
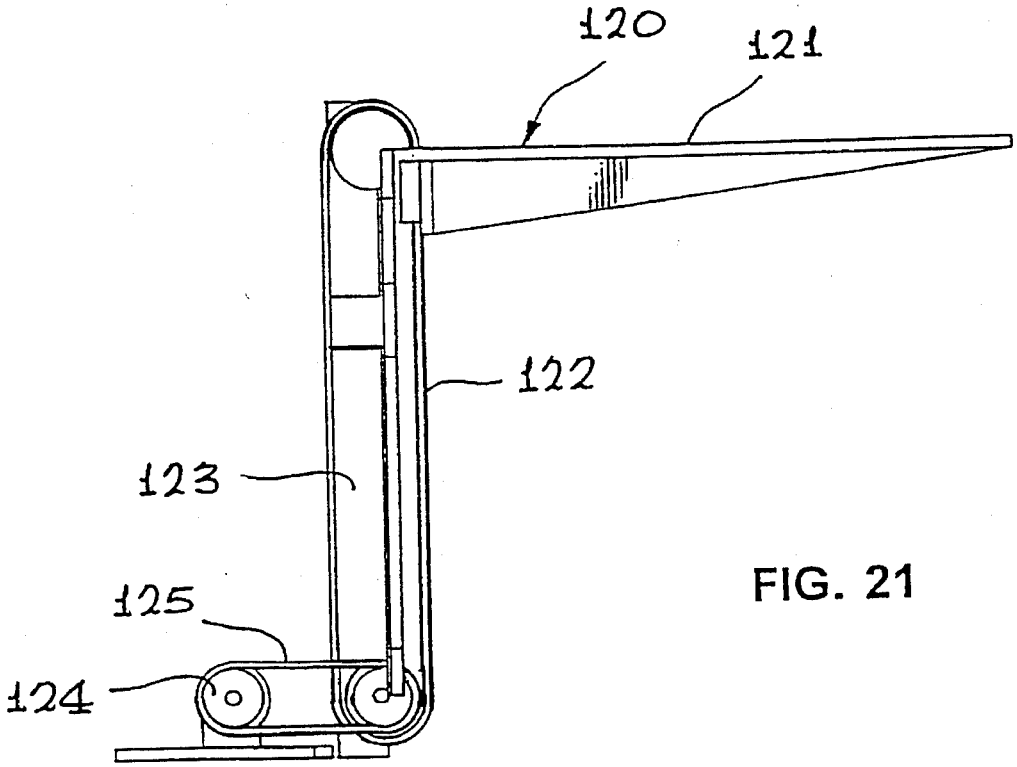
FIG. 21

BAG MAKING MACHINE

BACKGROUND OF THE INVENTION

The manufacture of bags such as the open mesh bags commonly used for the transportation and marketing of vegetables has progressed from the manual or stack cutting of bag material followed by manual sewing on a machine by an operator. Semi-automated machines have come into use with one or more of the operations conducted without operator attendance. Fully automated bag making machines have been a long felt need, however, none seem to have met all of the requirements of the industry or have such low throughput as to be uneconomic.

We have carefully examined the needs of bag producers and semi and automated machines available and have recognized the continuing need. Below are patents which are representative of the state of the art of bag making, known to the applicants:

U.S. Pat. No. 3,227,119 G. T. Gore, et al Jan. 4, 1966

This patent shows an exemplary apparatus for producing pillowcases, bags and the like in which continuous material is cut into individual sections before folding. The bags are sewn by moving sewing machines.

U.S. Pat. No. 3,424,113 E. D. Dickmann Jan. 28, 1969

His patent shows apparatus for sewing the end of tubular bag material with a tape and subsequently cut into individual bags at the tape.

U.S. Pat. No. 3,459,142 H. B. Berg Aug. 5, 1969

A bag stitching machine is disclosed in which the material is transported flat to a first fixed sewing machine, one seam sewn the bag is turned 90 degrees and then the next seam is sewn.

U.S. Pat. No. 4,224,883 Zeigler, Jr. et al Sep. 30, 1980

U.S. Pat. No. 4,214,541 Zeigler, Jr. et al Jul. 29, 1980

These two related patents show method and apparatus for manufacturing pillowcases in which continuous material is first hemmed, then cut into individual blanks and then folded for further processing.

U.S. Pat. No. 4,388,679 Everett, Jr. et al Jun. 21, 1983

Apparatus is disclosed for manufacturing pillowcases from continuous tubular material.

U.S. Pat. No. 4,580,509 Schell, et al Apr. 8, 1986

A system for sewing thread connected individual workpieces which are only connected together by the thread connection.

U.S. Pat. No. 4,685,407 H. Junemann Aug. 11, 1987

This patent discloses apparatus for flat sewing various garment parts such as sleeves and pocket shaped workpieces such as cuffs.

U.S. Pat. No. 4,754,717 Henze, et al Jul. 5, 1988

Disclosed is apparatus for forming covers by first cutting each section and then transporting each section flat for folding and subsequent sewing by fixed sewing machines.

U.S. Pat. No. 4,821,656 Dordi, et al Apr. 18, 1989

This patent represents apparatus for forming a cover for a mattress directly on the carcass or body of the mattress by forming beaded seams at each corner.

These patents reflect the need for automated or semi-automated apparatus for the production of bags or bag like sewn assemblies but fail to disclose the features set forth below which we have been able to develop and incorporate into our invention:

1. The use of a rotating drum which provides the functions of folding each bag blank, holding a series of folded blanks, cutting the folded blanks into individual blanks and delivering them to a position for transport, sewing and stacking.
2. Individual clamp members on the periphery of a drum which tension a width of the bag material for cutting with a transverse moving cutter.
3. The use of a reciprocating folding blade which aids in holding material in a bag fold making clamp until the jaws are fully closed to maintain tension on the bag material and the required fold size until the material is cut.
4. The feature in which the reciprocating overlapping carriers each have a holddown member to hold the material adjacent to the sewing machine head but one of the holddown members is automatically retracted when in a non-material holding condition for non-interfering passage of the two reciprocating carriers.
5. The presence of reciprocating, overlapping carriers for each bag through a fixed sewing machine for sewing at least one seam.
6. The process including the step of folding a continuous strip of bag material before cutting into individual bag blanks allowing the tensioning of the uncut strip to aid in the folding, transferring and cutting operations.

BRIEF DESCRIPTION OF THE DRAWINGS

This invention maybe more clearly understood from the following detailed description and by reference to the drawing in which:

FIG. 20 is a simplified top plan view of the elevator or stacker of this invention;

FIG. 21 is a side elevational view of the finished bag elevator or stacker of FIGS. 1, 20 and 20A;

DETAILED DESCRIPTION OF THE INVENTION

Figure 1:
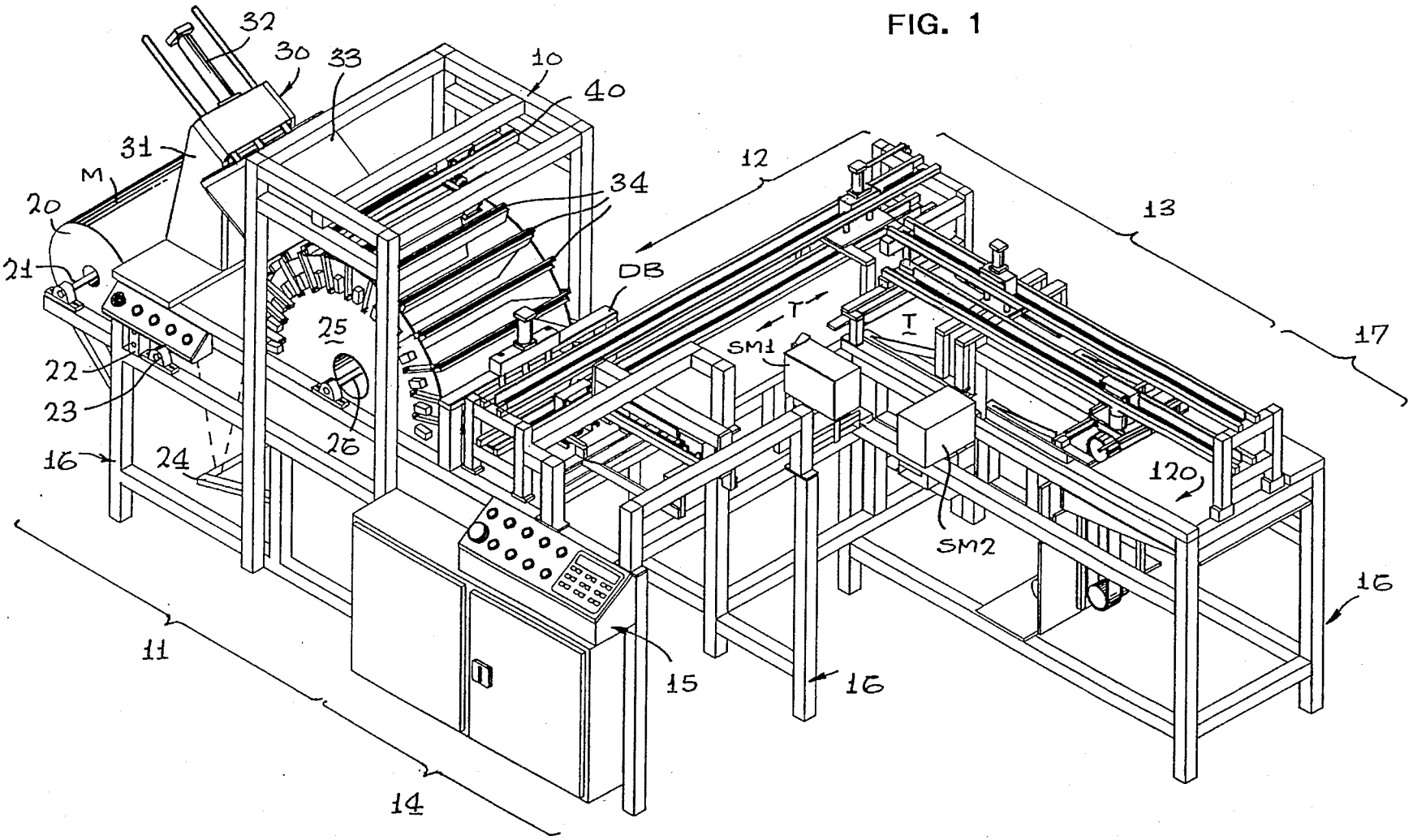
FIG. 1 is a perspective drawing of a bag making machine in accordance with this invention.
Figure 1A:
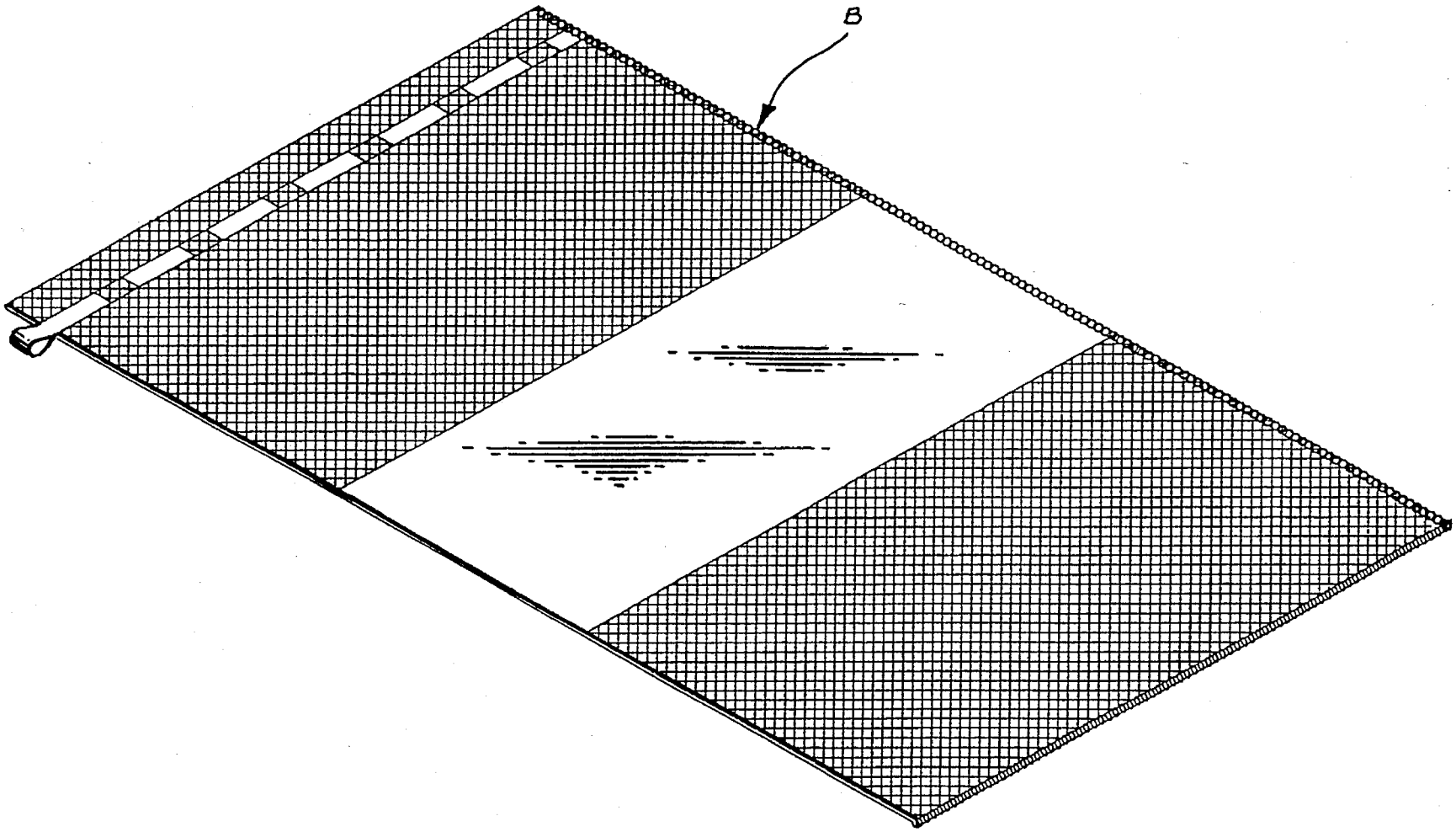
FIG. 1*a* is a perspective view of a typical bag produced by this invention.
Figure 2:
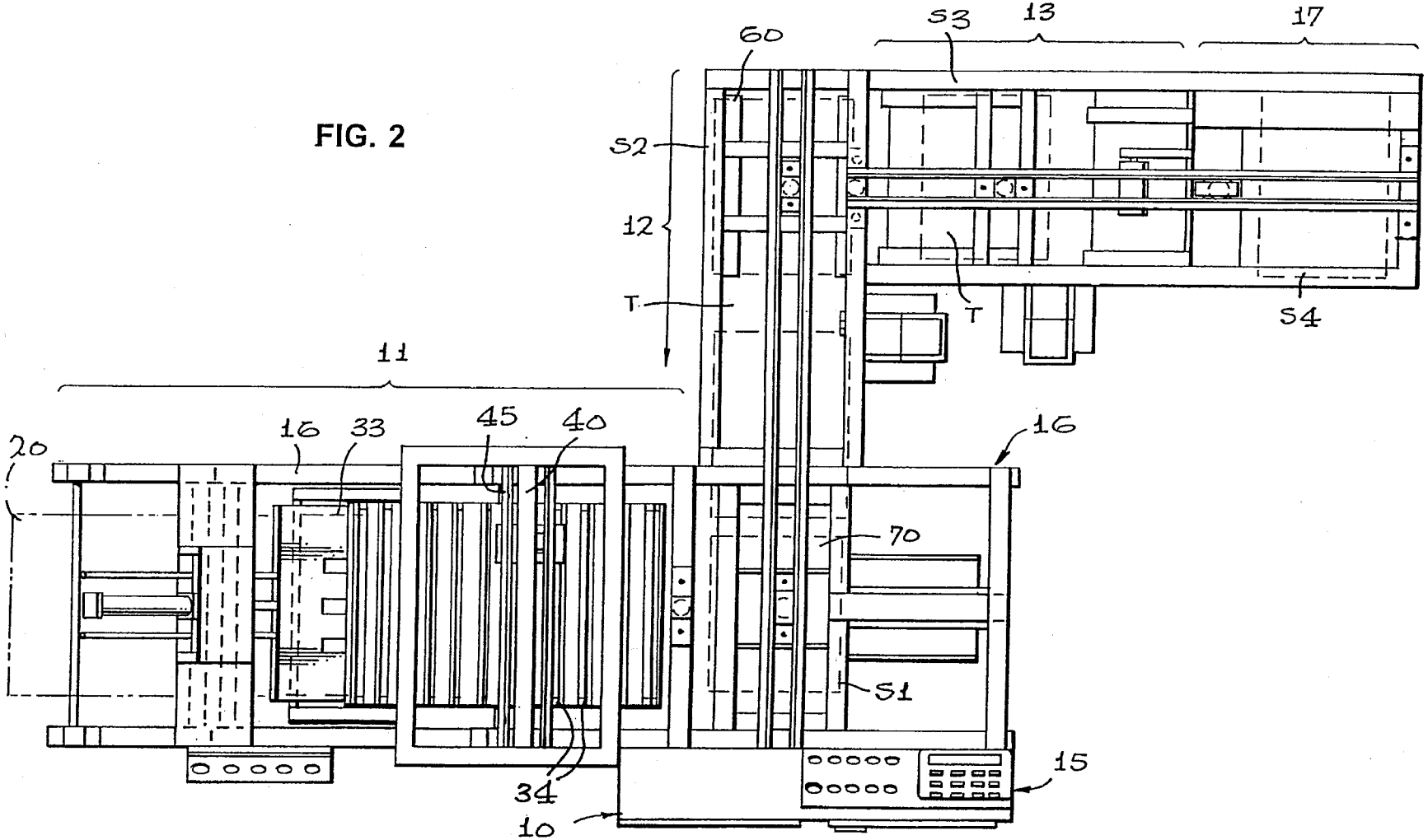
FIG. 2 is a top plan view the bag making machine of FIG. 1.

For an overview of this invention, reference is now made to FIGS. 1 and 2 showing in perspective and top plan view, an embodiment of the invention designed to automatically produce and stack bags B of the type shown in FIG. 1A. The machine, generally designated 10, comprising a supply and fold subassembly 11 which includes a supply mandrel with a roll of bag material M, a folder, a cutter and a transporter, described below, to produce a folded bag blank FB, ready for sewing. The supply and fold subassembly 11 is located adjacent to a first stage transport and sewing subassembly 12 which includes a first sewing machine SM1 and is oriented at a 90 degree angle with respect to the initial direction of travel of bag material M in subassembly 11.

The first stage transport and sewing subassembly 12 joins a second stage transport and sewing subassembly 13 at a 90 degree angle with respect to the direction of travel of the partly sewn bags in the first stage. The second stage transport and subassembly 13 includes a folded single seam sewn bag transport and a second sewing machine SM2. A bag elevator 17 to hold completed bags adjoins the second stage assembly 13. All of the subsystems are under the control of a computer control module 14 with its control panel 15. The entire machine 10 is mounted on a frame assembly 16 to complete the system.

THE SUPPLY AND FOLD SUBASSEMBLY

Figure 3:
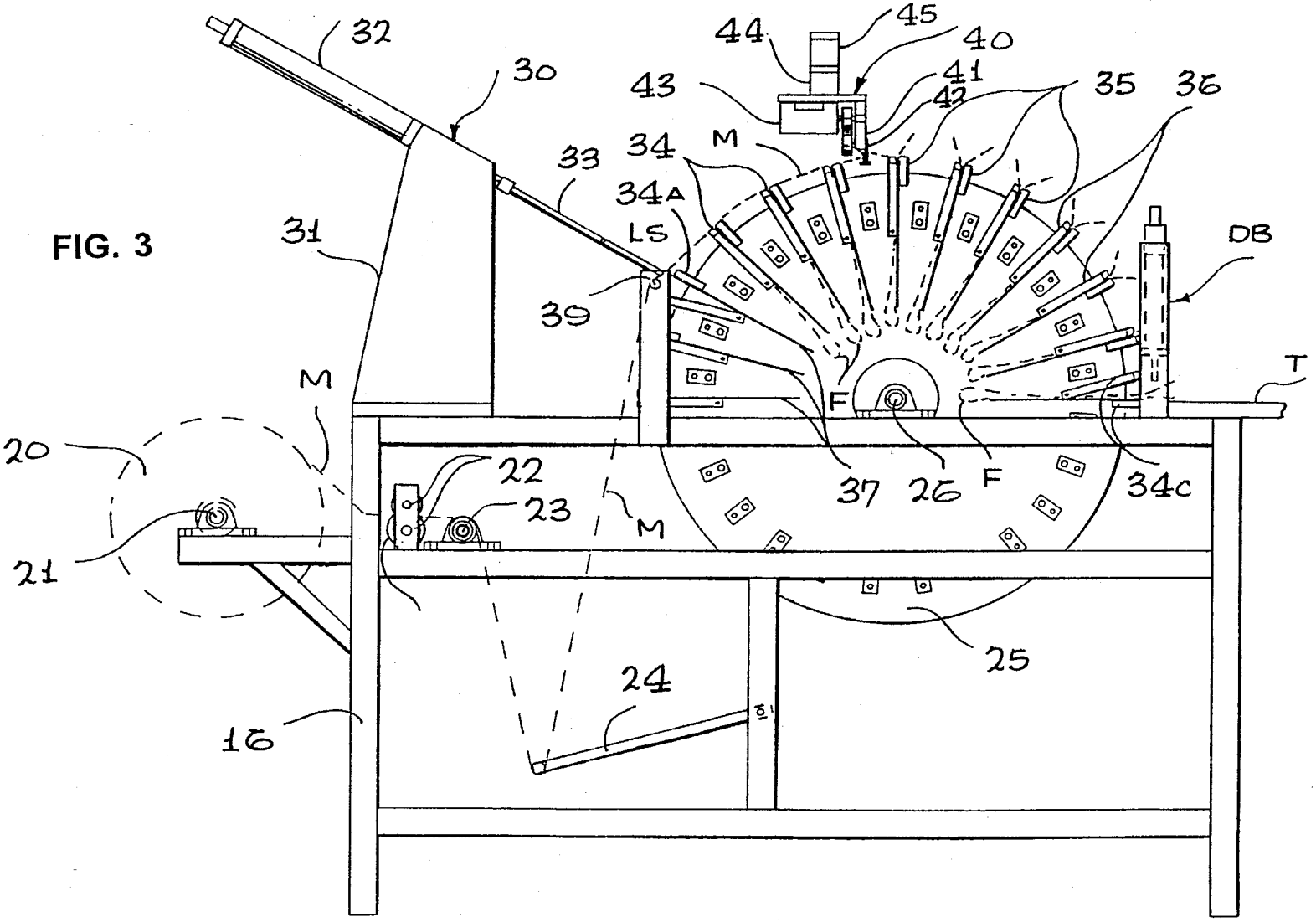
FIG. 3 is a simplified front elevational view of the supply and folder subassembly of the machine of FIG. 1.

Referring next to FIGS. 1 and 2 in connection with FIG. 3, a roll 20 of bag material M is supported on mandrel 21 on the frame 16 with the material M unrolling through motor driven feed or squeeze rollers 22 riven by a gear motor 22*a*, over a mandrel 23, under a pivoted dancer bar 24 and upward to a folder/cutter drum or reel 25 which is also mounted on a mandrel 26 for incremental rotational advance under the control of the control module 14 with incremental stops at a number of angular positions, for example, 24 or 36, one for each bag folding operation. Also located on the frame 16 is a folder blade subassembly 30 including a support 31, an actuator cylinder 32 and a folder blade 33. The blade 33 which has a very smooth surface is positioned over a stop position on the drum or reel 25, as best seen in FIG. 3.

Now referring to FIG. 3, the drum 25 mounts identical clamp assemblies 34, each including one fixed jaw 35 and a movable jaw 36 as well as a fold separator plate 37. The jaws 35 and 36 are each covered with a rubberized friction coating or layer to grip each fold F as formed by the entrance of the folder blade 33 into each a clamp assembly 34 as it is positioned at the loading station LS which is shown in FIG. 3 with the movable jaw 36 open and the blade 33 ready to be driven into the clamp 34 by its blade actuator 32.

Figure 5:
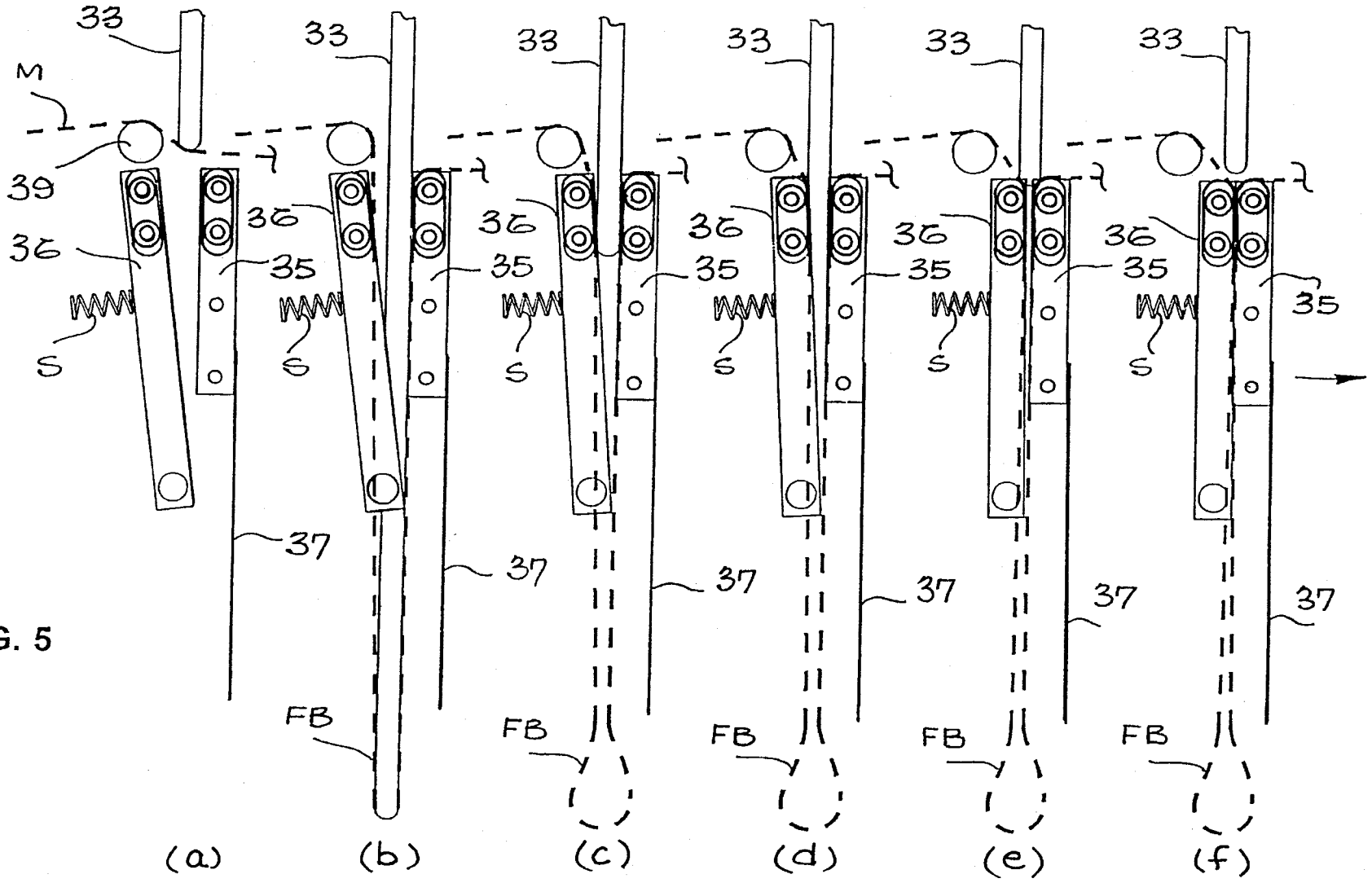
FIG. 5 is a simplified sequence diagram of the bag folding operation of this invention.

Note, in FIG. 3 and in connection with the sequence diagram of FIG. 5, that the material M is in a continuous strip to the loading station LS and beyond that station through the next three loaded clamps 34 until it reaches the uppermost or 12:00 o'clock position where each fold is separated by the cutter assembly 40 best shown in detail in FIGS. 6, 9*b*, 9*c* and 9*d*.

The presence of uncut material M after the loading station LS insures tension upon the material M and that the fold F, formed by the folder blade 33 is drawn from the dancer bar 24 which is fed by feed roller 22 and not from the previous loaded clamps 34.

Figure 4:
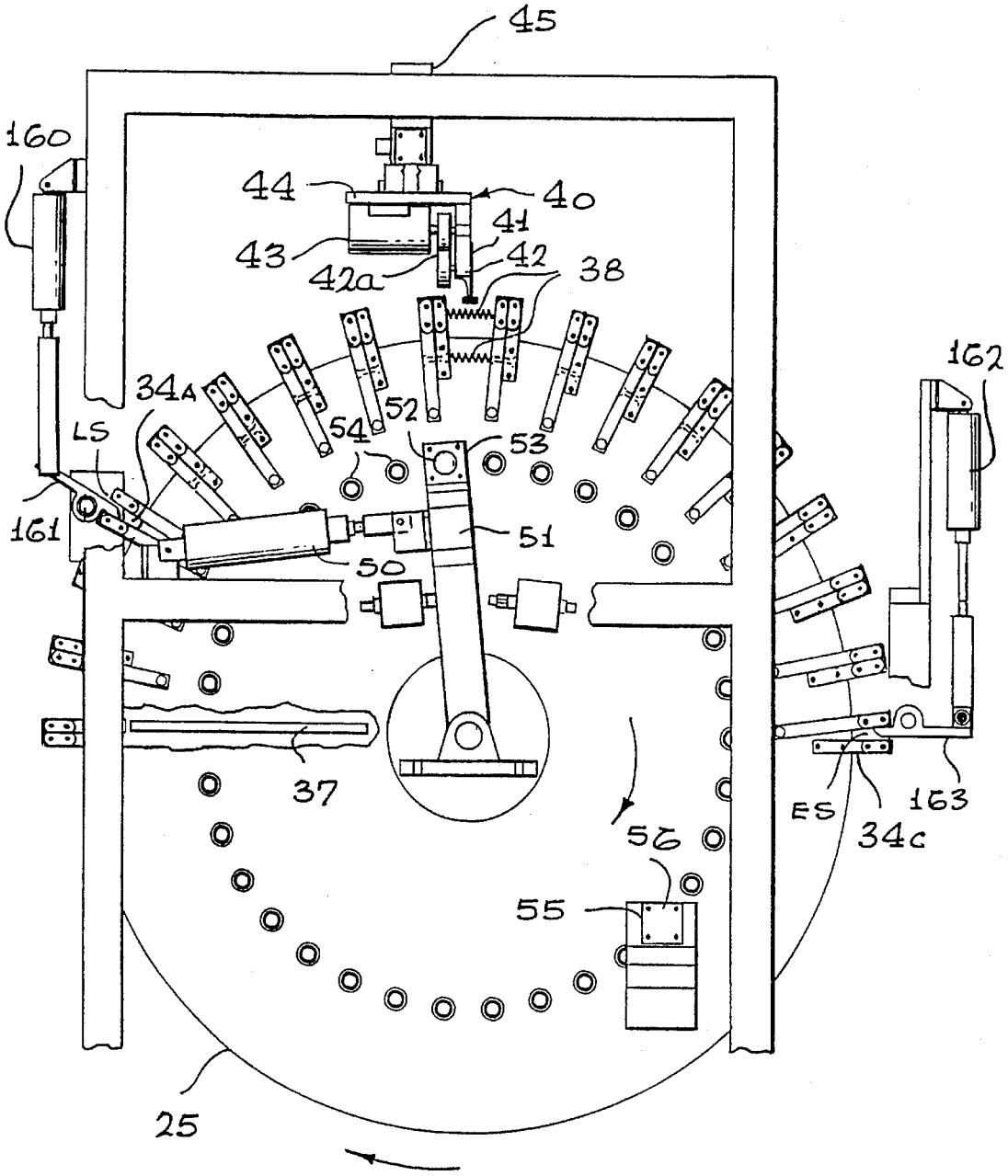
FIG. 4 is a rear elevational view of the supply and folder sub assembly of the bag making machine of FIG. 1.

FIG. 4 shows the front side of the drum 25 and its actuators as well as the cutter assembly 40 which comprises a rotating cutter blade 41 on a shaft 42 which is belt driven by cutter motor 43 on a carriage 44 supported on the top bar and actuator 45 of the machine frame 16. The cutter assembly 40 is mounted for reciprocal movement each time that the drum 25 is stationary to separate the adjacent fold from the succeeding folds prior to its further processing.

The drum 25 is rotated in steps by drum actuator 50, acting through drum drive arm 51 which includes a retractable cylinder actuated pin 52. The pin 52 is actuated by air cylinder 53 to enter each alignment hole 54, advance the drum 25 by one increment, e.g., 15 or 10 degrees, and then retract. A locking actuator 55 and pin 56 are operated to hold the drum 25 in position while the drum actuator 50 and its arm 51 are retracted in position over the next hole 54. Two additional actuators also appear in FIG. 4; they are the clamp opening actuator 160 with its pivoted lever 161 and, at nearly an opposite position on the drum 25, the fold release actuator 162 and its lever 163.

In FIG. 3 and FIG. 5*a* and unshown in FIG. 4, the blade 33 is poised for entry into the open clamp assembly 34A and the material M is positioned over the open jaws 35 and 36 by a bar 39. When the blade 33 is driven into the open jaws by its actuator 32, it draws material from the dancer bar 24 loop an amount equal to double the length L of blade 33 to form a bag blank FB of length L. It should also be noted that the movable jaw 36 of each clamp assembly 34 is held closed by a pair of springs 38 at each end. In FIG. 4, only one set of springs 38 is shown to avoid overcrowding the drawing. It must be recognized that each clamp assembly 34 has two sets of spring pairs 38. In this case, in which the drum 25 has 36 clamps and incremental steps, there are 72 pairs of springs employed, two pairs for each clamp assembly 34. Similarly, only 18 clamp assemblies 34 are shown in FIG. 4A, for clarity. No action occurs in the half of travel of the drum 25 from the folded bag blank extracting station ES at clamp 34C to the loading station LS at clamp 34A except to advance the empty clamp assemblies 34 to the material loading position LS which is at the jaws of the clamp assembly 34A at the lever 161 and tip of blade 33 of FIG. 3.

The folding sequence of this machine is illustrated in FIG. 5 in simplified form and in 7(*a*)–(*d*) on the drum 25. In FIG. 5, six sequential steps (*a*)–(*f*) in the folding operation are illustrated. The bag material is tensioned to the right. The blade 33 contacts the material M as it passes over rod 39 and it driven downward into the mechanically opened clamp 34 between its jaws 35, 36. The jaws 35, 36 are friction material covered so they hold the material M against the smooth blade 33. Blade 33 draws the full width of the bag as a fold FB and withdraws leaving the fold in the clamp 34. Note in FIG. 5(*e*) that the top of the blade 33 remains in contact with the jaws 35 and 36 and the material M until the jaws 35, 36 are fully closed. With the clamp 34 fully closed, the drum can now advance to the right as noted by the arrow adjacent to the clamp 34 in FIG. 5(*f*).

In FIG. 7, an X on the material M shows its movement during a folding sequence. In FIG. 7(*a*), blade 33 is in its rest position, fully withdrawn from clamp 34 and the material marked X is located just ahead of the dancer bar 24. In FIG. 7(*b*) the blade 33 has partially entered the clamp 34A and material M has been drawn until the X is past the dancer bar 24. In FIG. 7(*c*) the material M has been drawn into the clamp 34A by inward motion of blade 33 causing the dancer bar 24 to move upward and the X is now located at the entrance of the clamp 34A. In FIGS. 7(*d*) and 5(*e*), the blade 33 is nearly withdrawn from the clamp 34A and its tip rests at the edge of the jaws 35 and 36 to hold the material until the clamp is fully closed and its friction material holds the two layers of material M for transport.

Each of the clamps 34, after receiving a fold and closing, act as tensioners of the material M until passed the cutting station described below.

Figure 6:
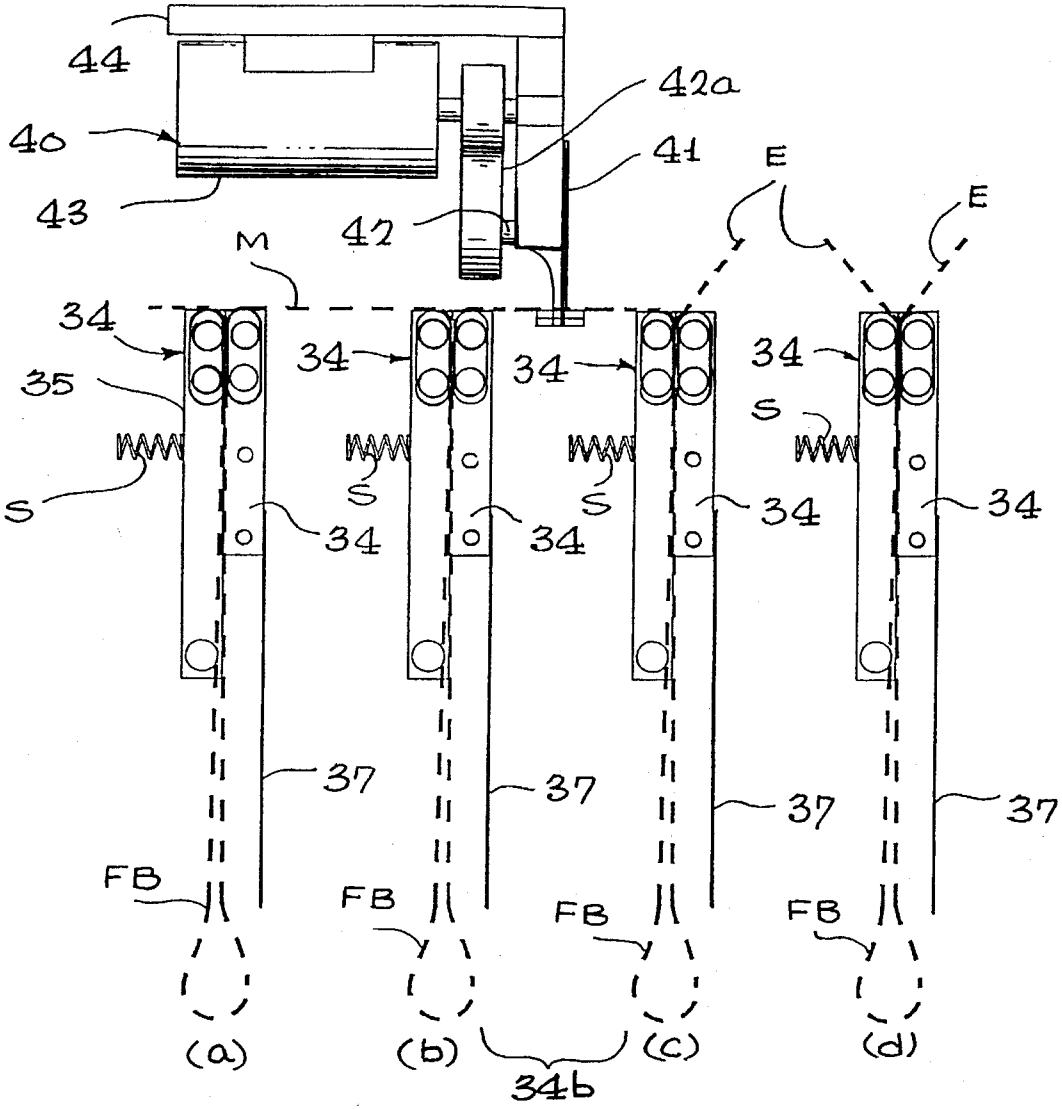
FIG. 6 is a simplified sequence diagram of the cutting operation of this invention.
Figure 7A:
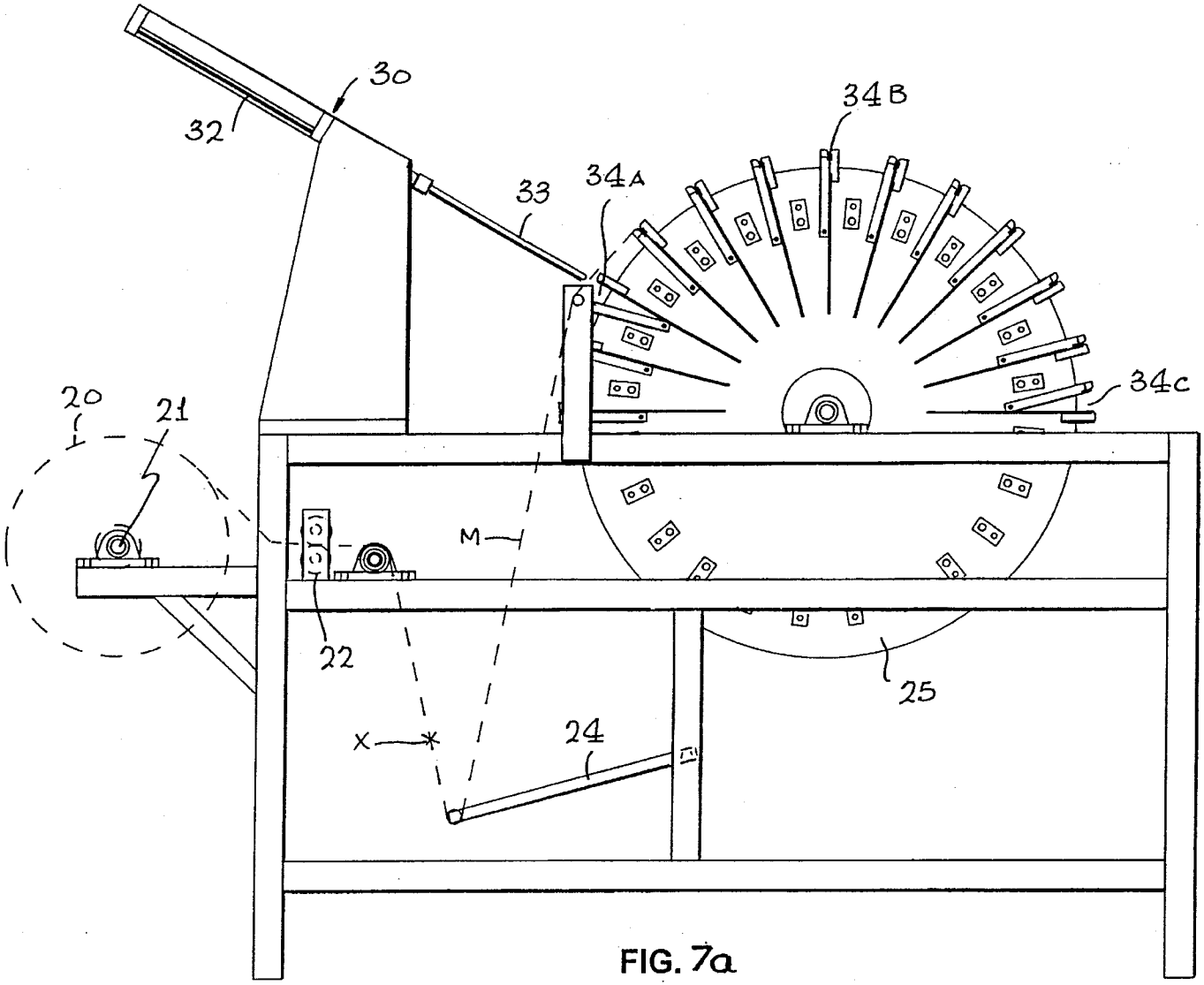
FIG. 7(*a*)–(*d*) is a sequence diagram for the supply and folding subassembly of FIGS. 1 and 2.
Figure 7B:
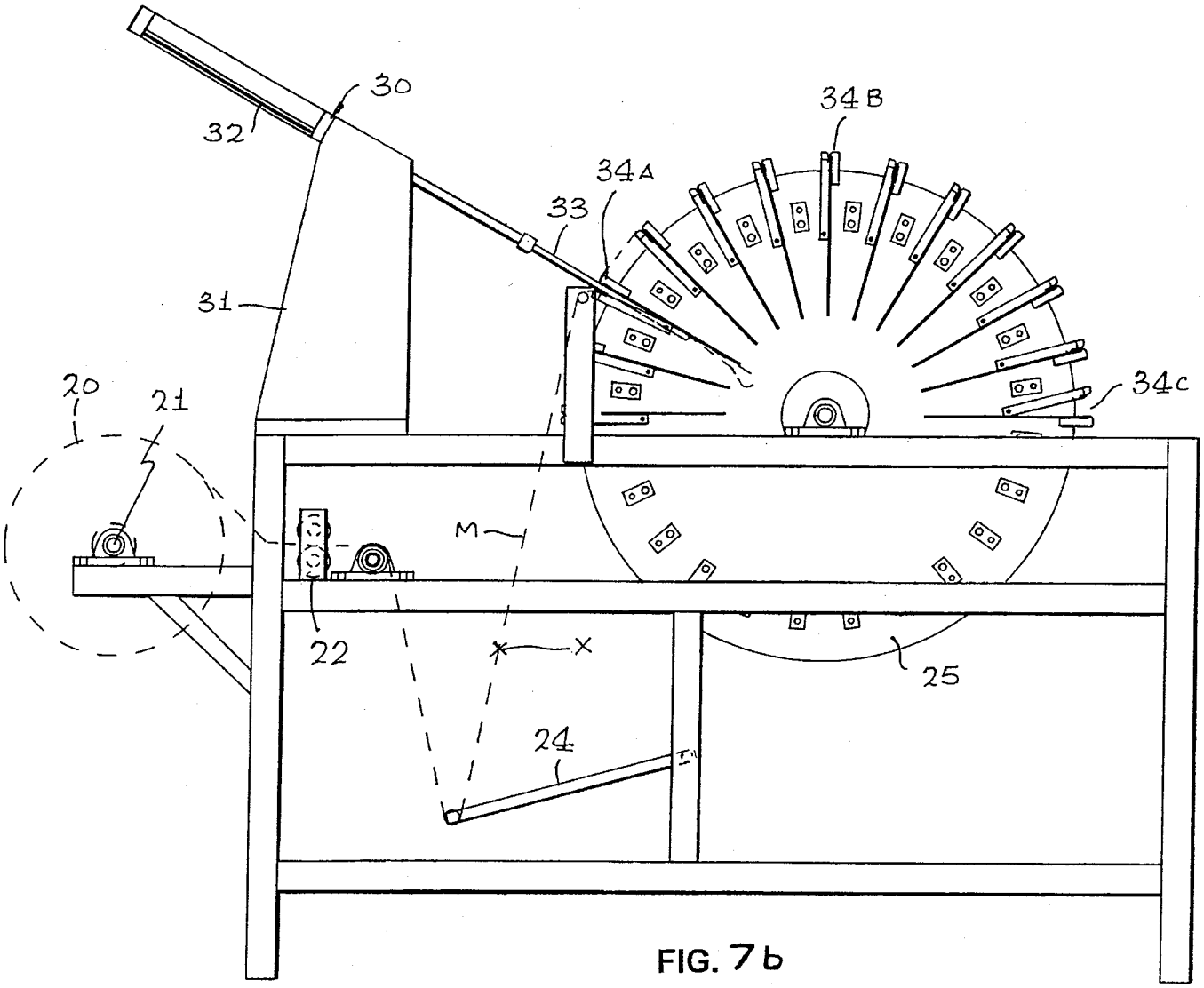
Figure 7C:
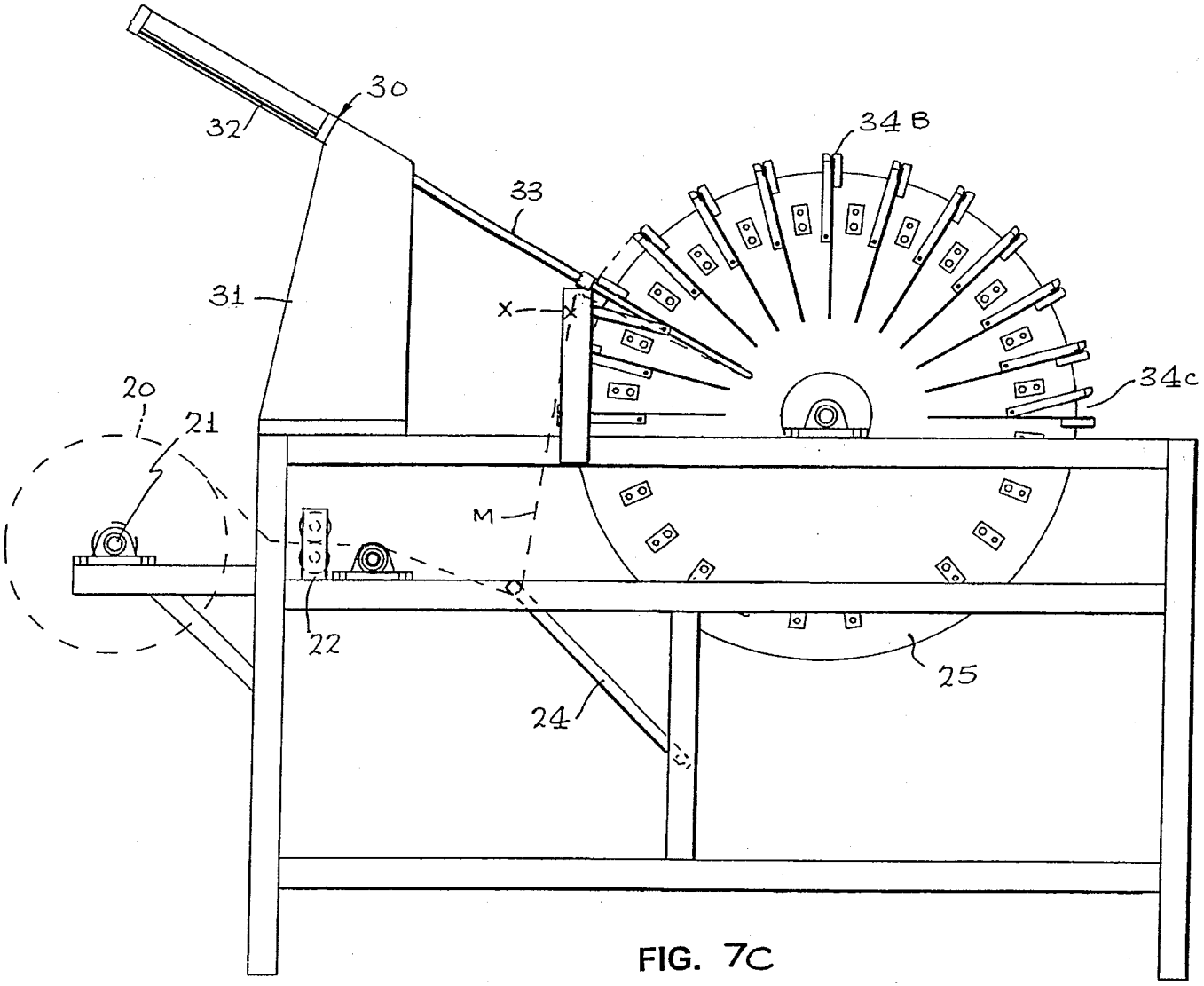
Figure 7D:
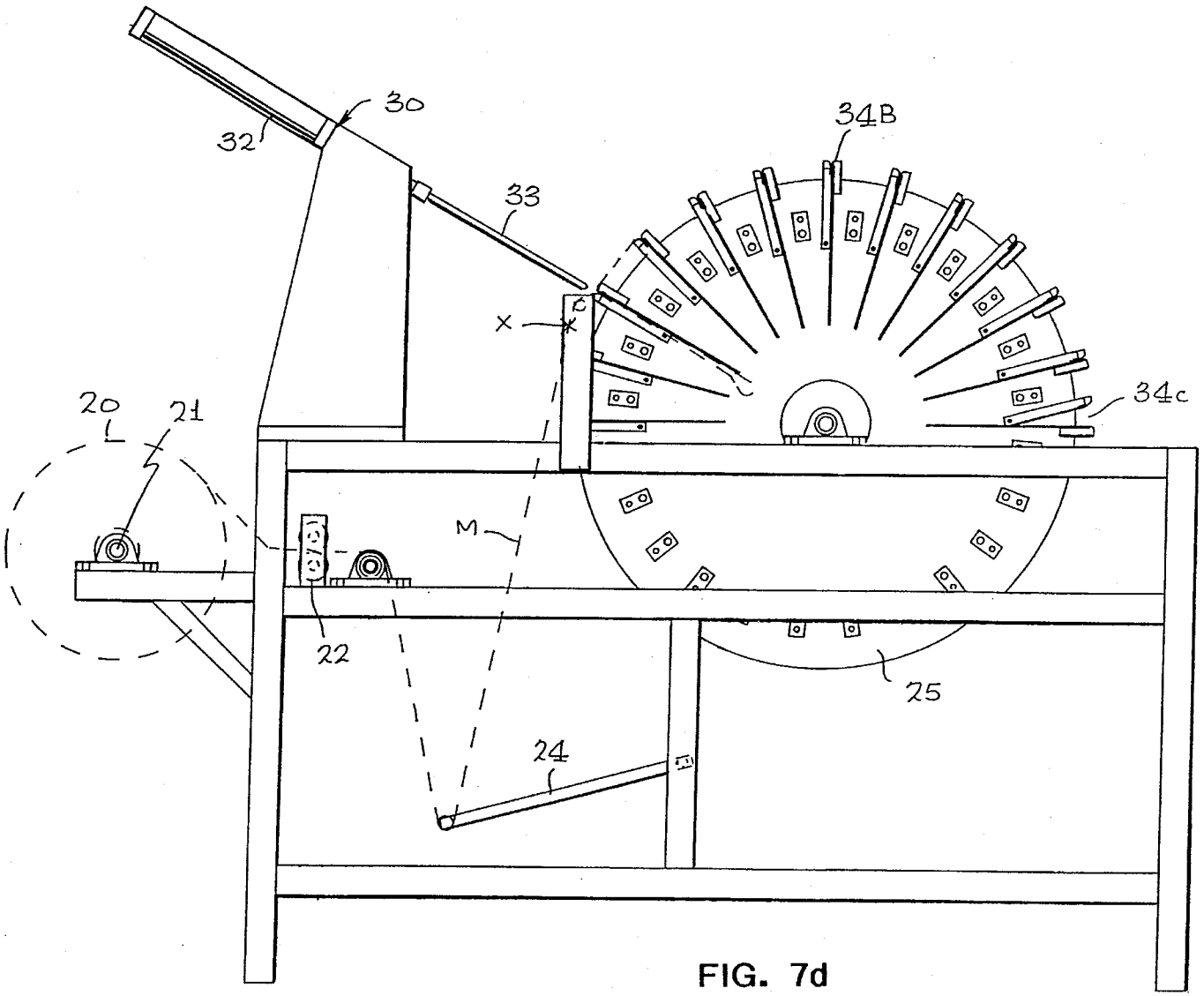
Figure 9A:
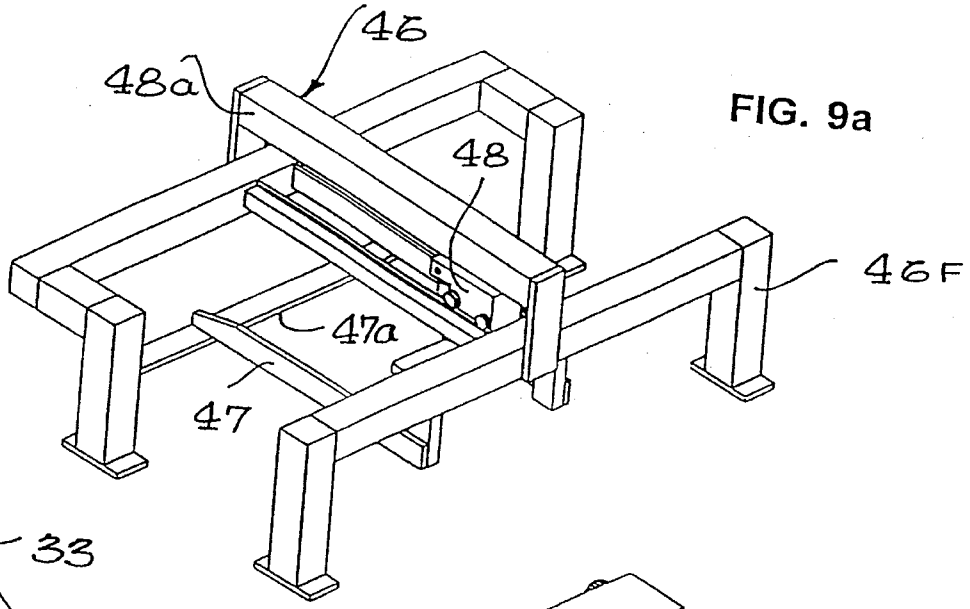
FIG. 9*a* is a perspective view of the extracting clamp assembly of FIGS. 1 and 3.
Figure 9B:
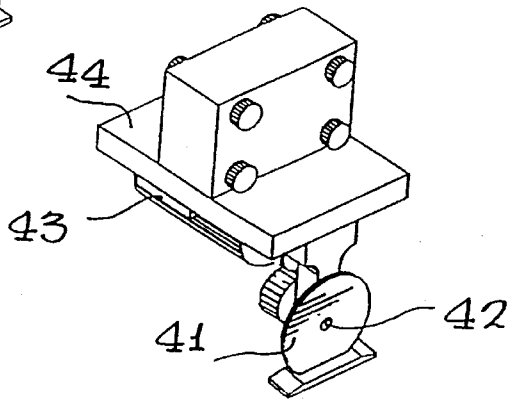
FIG. 9*b* is a perspective view of the cutter blade and drive of FIGS. 1, 3, 4, and 6.
Figure 8:
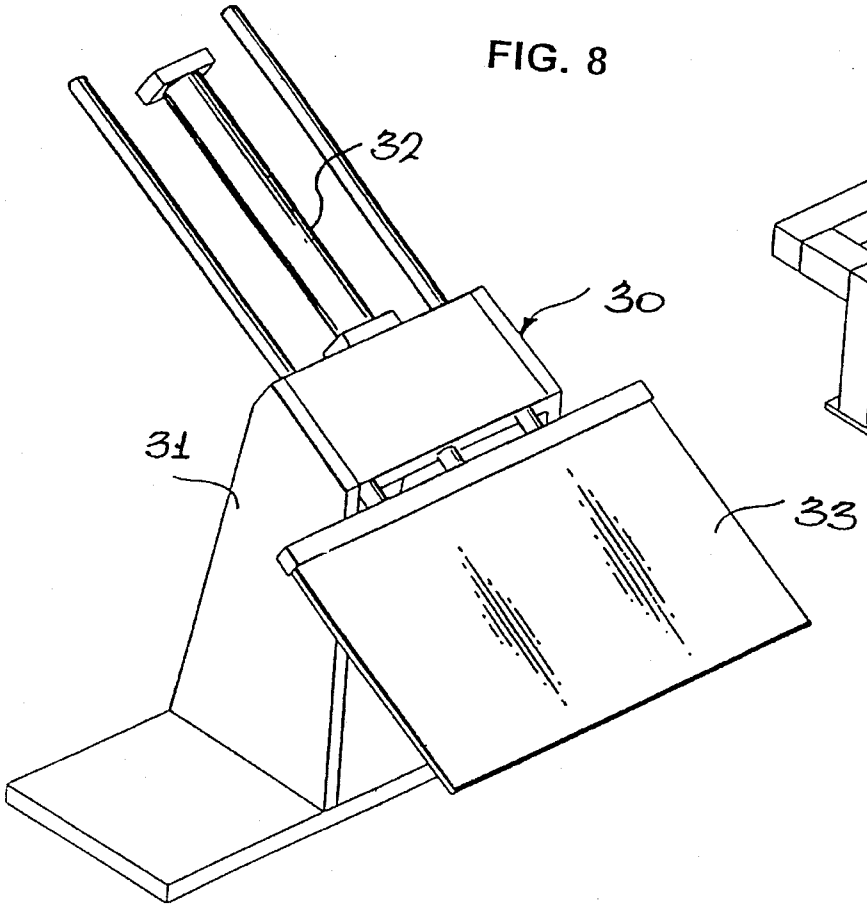
FIG. 8 is a perspective view of the folding blade and actuator of the folding and cutting subassembly of FIGS. 3 and 7.
Figure 9D:
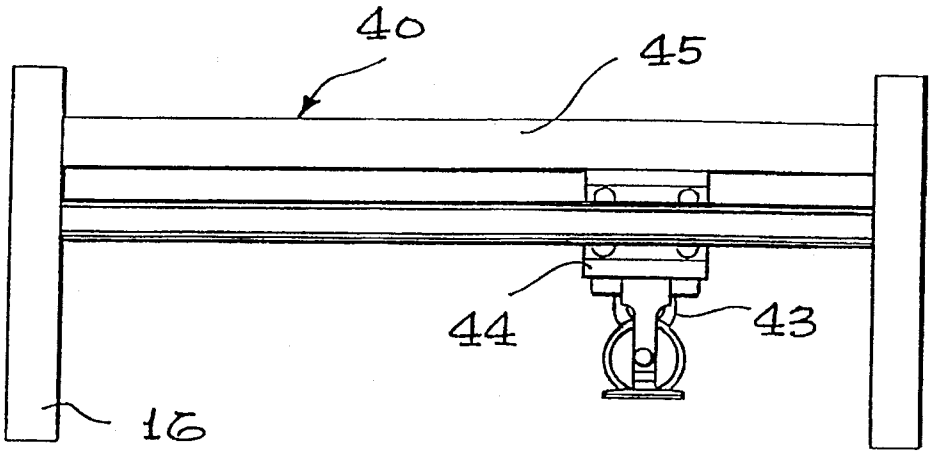
FIG. 9*d* is a side elevational view of the cutter assembly.
Figure 9C:
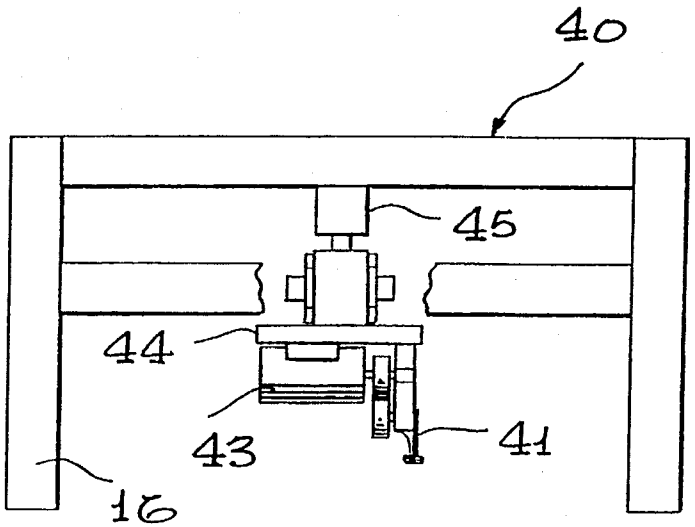
FIG. 9*c* front elevational view of the cutter assembly.

In FIGS. 6 and 7, the material M may be seen as continuous from the roll 20 through to clamp 34B where it has been severed by the cutter assembly 40 at the 12 o'clock position. All of the clamps 34 from the 12 o'clock position to the 3 o'clock position of FIG. 3 show the folded bag blank FB with its ends cut and ready for sewing. This cutting operation is shown in the sequence diagram of FIG. 6.

The cutting sequence is illustrated in FIGS. 6(*a*)–(*d*) in which the material M is held in adjacent clamp 34 until it reaches position 34B, (FIG. 7(*c*)) where the cutter 40 travels the length of the drum 25 severing material M. Thereafter, the ends E of each fold FB are free with the fold FB still restrained in their respective clamps 34.

At the three o'clock position of the drum 25 in FIG. 3, the clamp assembly 34C is shown as open. This position corresponds to the level of the transport table T which is a smooth, e.g., stainless steel surface which extends throughout the first and second stage sewing assemblies 12 and 13 all the way to the elevator 17 where it terminates.

Figure 10:
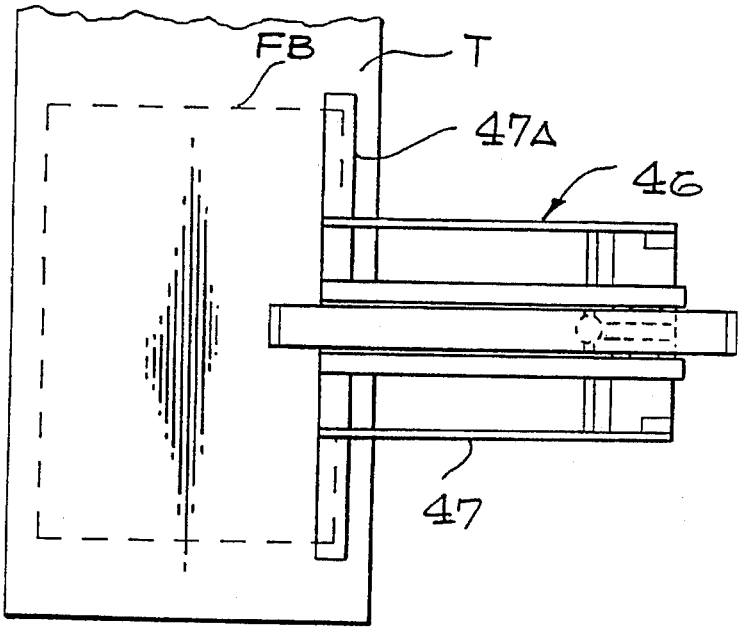
FIG. 10 is a top plan view of the bag blank extracting clamp assembly of the machine of FIG. 1.
Figure 11:
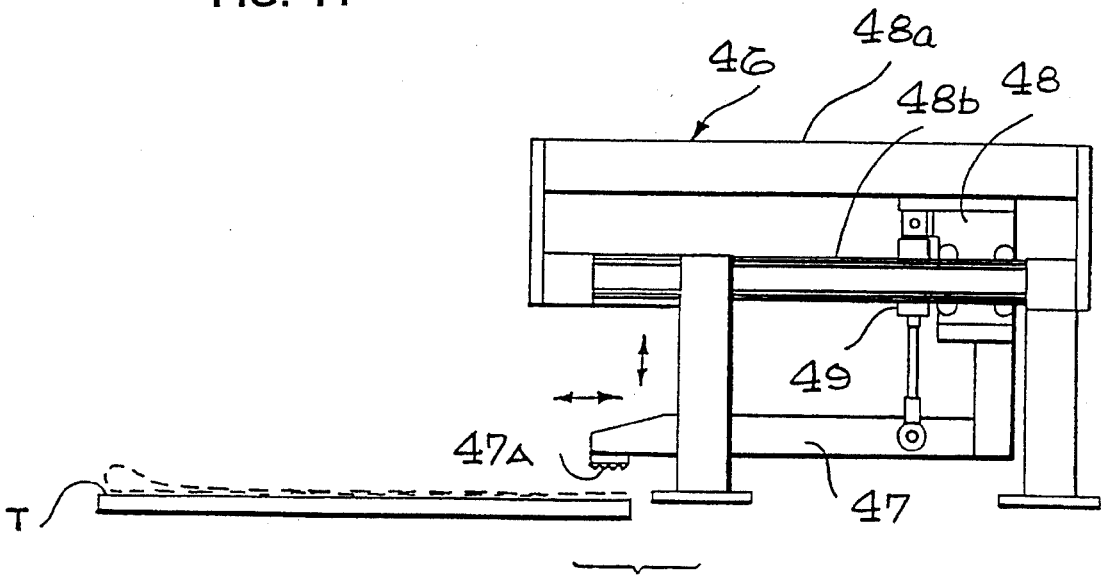
FIG. 11 is a side elevational view of the bag blank extracting clamp assembly of FIG. 10.
Figure 22:
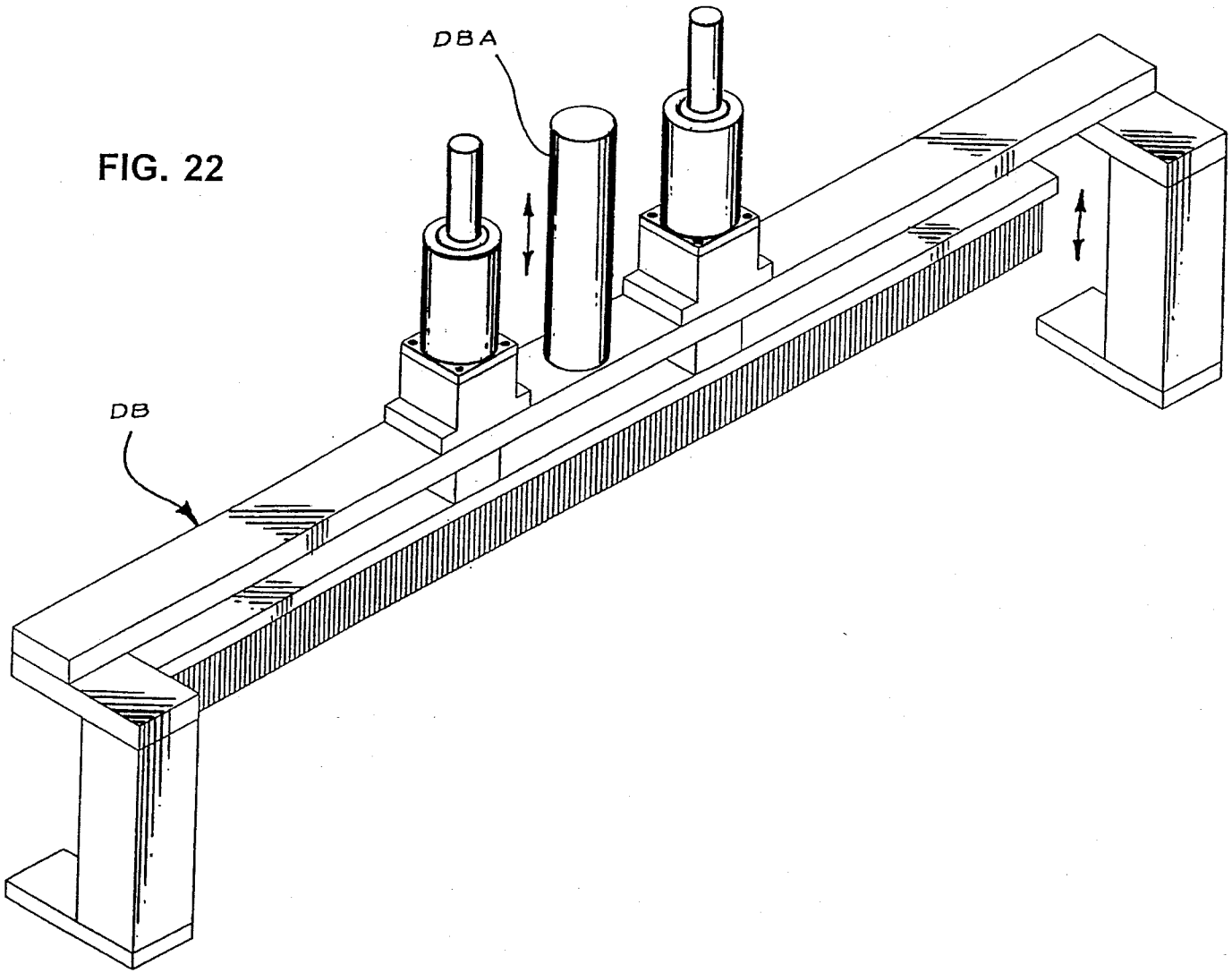
FIG. 22 is a perspective view of the drag brush assemblies of FIGS. 1 and 2 of this invention.

At position 34C, the folded cut bag blank FB is removed from the drum 25 by an extractor clamp assembly 46 of FIGS. 1, 9*a*, 10, and 11 including a frame 46F, a pivoted clamp arm 47 with a high friction pressure plate 47A which is moved forward by actuator/slide 48, to the left in FIG. 11 and pivoted downwardly by an actuator 49 of FIG. 11 to engage the folded bag blank FB on table T and to draw it into position for transport by the first stage transport and sewing subassembly 12 of FIGS. 1, and 12 through 19. A drag brush assembly DB as shown in FIG. 22 is actuated by its actuator DBA to rest over the folded bag blank FB to maintain the folded bag blank flat and unwrinkled as it is drawn from the snbassembly 11.

THE FIRST STAGE TRANSPORT AND SEWING SUBASSEMBLY

Figure 12:
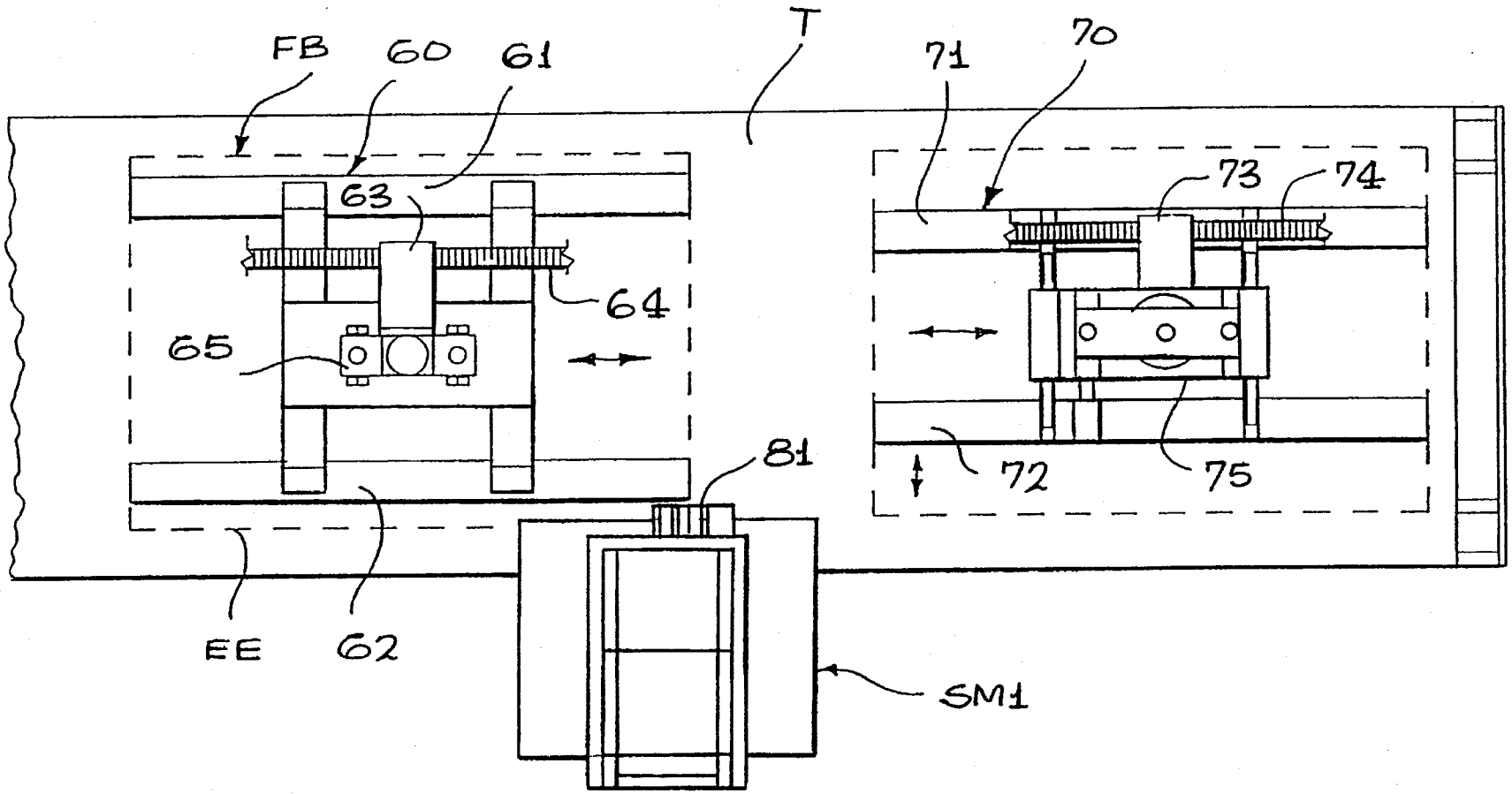
FIG. 12 is a top plan view of the reciprocating carriers of the first stage sewing subassembly.
Figure 14:
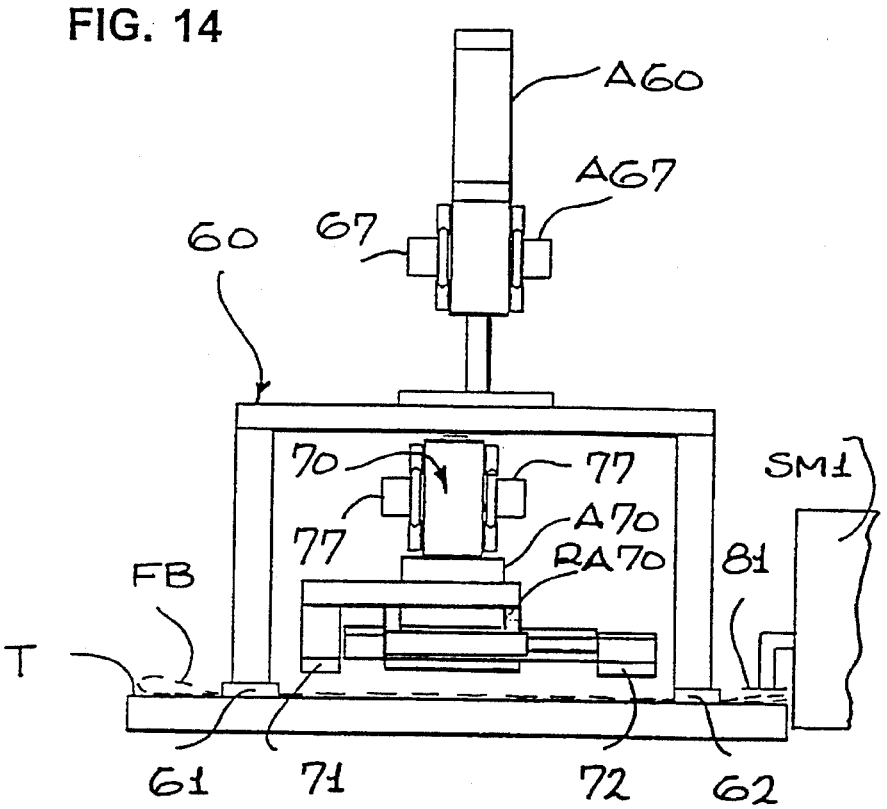
FIG. 14 is a supply end elevational view of the first and second carriages with the outer carriage holding a bag blank for the first sewing operation.
Figure 16:
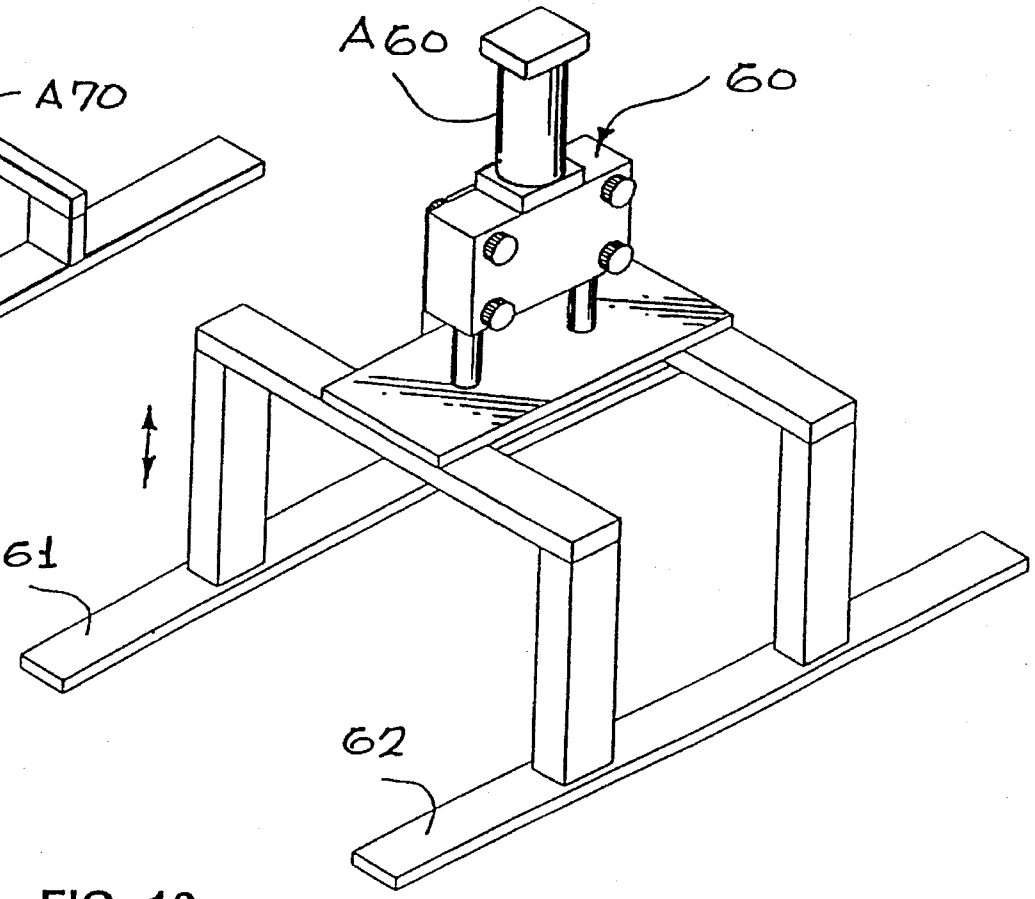
FIG. 16 is a perspective view of the outer carriage of FIGS. 1, 13 and 14.

After the folded, cut, bag blank FB emerges from the subassembly 11, it is ready for the first sewing operation. This commonly is the longer side of the bag B of FIG. 1A. As shown in FIGS. 10–12, the folded bag blank FB rests on table T with the cut edge E/E closest to the pressure plate 47A of and in position S1 of FIG. 2. Positioned over the table T are a pair of hold down and sewing carriage assemblies 60 and 70. The first sewing carriage assembly 60 is best seen in FIGS. 12, 14, and 16 includes a pair of hold down arms 61 and 62 and a bearing block attached to both ends of a timing belt 64 by drive belt connection clamp 63 timing belt 64 pulls first sewing carriage assembly 60 back and forth by means of motor drive M60. The first sewing carriage assembly 60 is driven forward and backward on a guide rail GR of FIGS. 1 and 17 from its position shown in FIG. 12 where it clamps the folded bag blank FB against table T and transports it past the first sewing machine head SM1 with the cut edge EE riding under the sewing machine presser foot 81 to complete the first seam by the time that the first sewing carriage assembly 60 reaches the opposite end of the intermediate section of table T.

Figure 13:
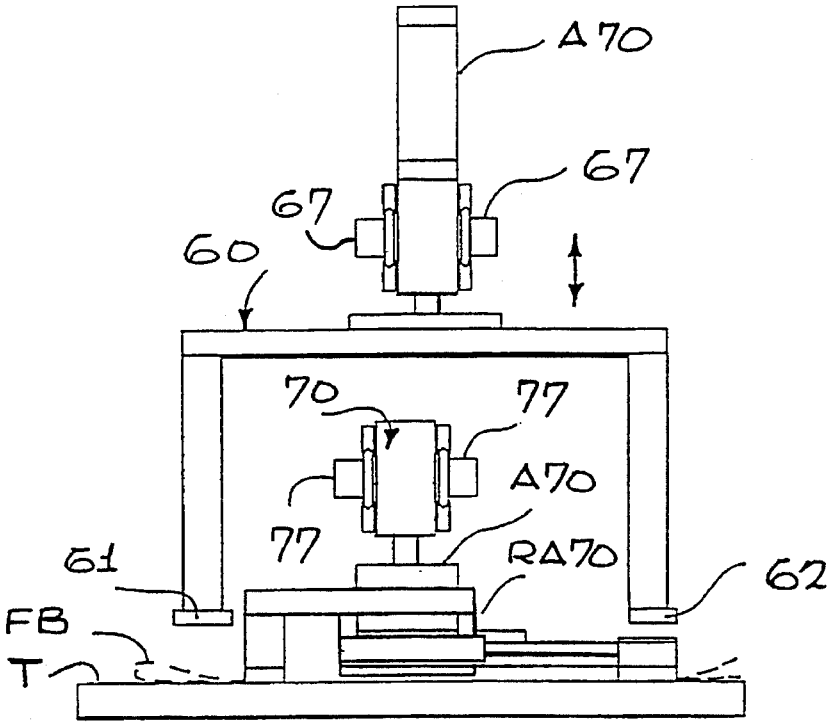
FIG. 13 is a supply end elevational view of the first and second carriages with the inner carriage holding a bag blank for the first sewing operation.

The second sewing carriage assembly 70 of FIGS. 12–15 is similar to first sewing carriage assembly 60 in the presence of holddown feet 71 and 72. Second sewing carriage assembly 70 travels on guide rail GR70 driven by either belt 64 for mechanically synchronized movement with first sewing carriage assembly 60 or by its own drive and timing belt 74 with electronic synchronization. In this latter case, as is illustrated in the drawing, second sewing carriage assembly 70 is driven by motor M70. It is important to note that the two sewing carriage assemblies 60 and 70 are configured for carriage 60 to pass over carriage 70 in both directions of travel to insure non interference. The overlapping relationship of the sewing carriage assemblies 60 and 70 are illustrated in FIGS. 13 and 14 showing second sewing carriage assembly 70 holding a folded bag blank FB and first sewing carriage assembly 60 in the upward positions in FIG. 13 and in its downward position in FIG. 14.

Figure 15:
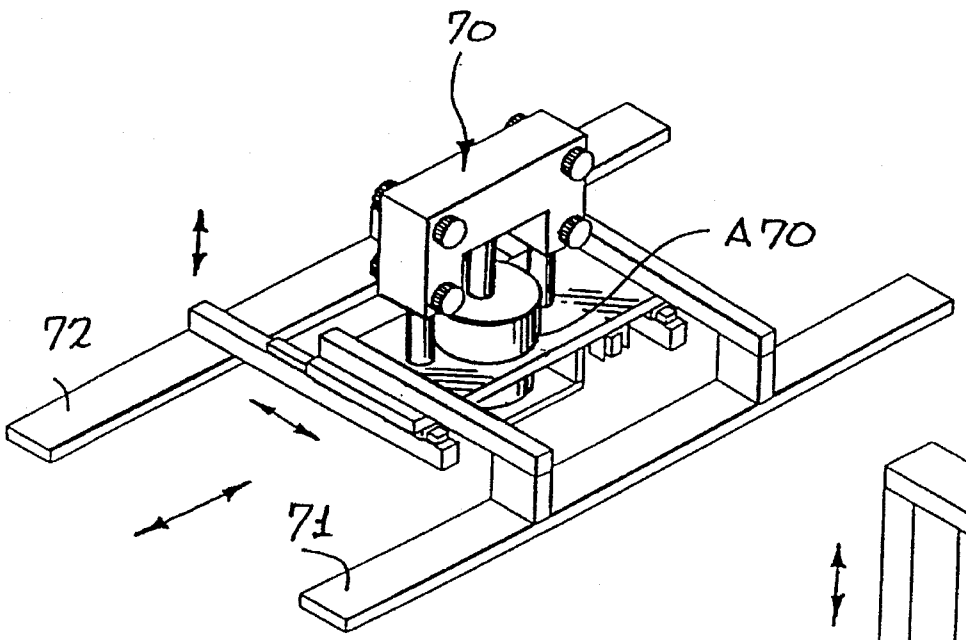
FIG. 15 is a perspective view of the inner carriage of FIGS. 1, 13 and 14.
Figure 17:
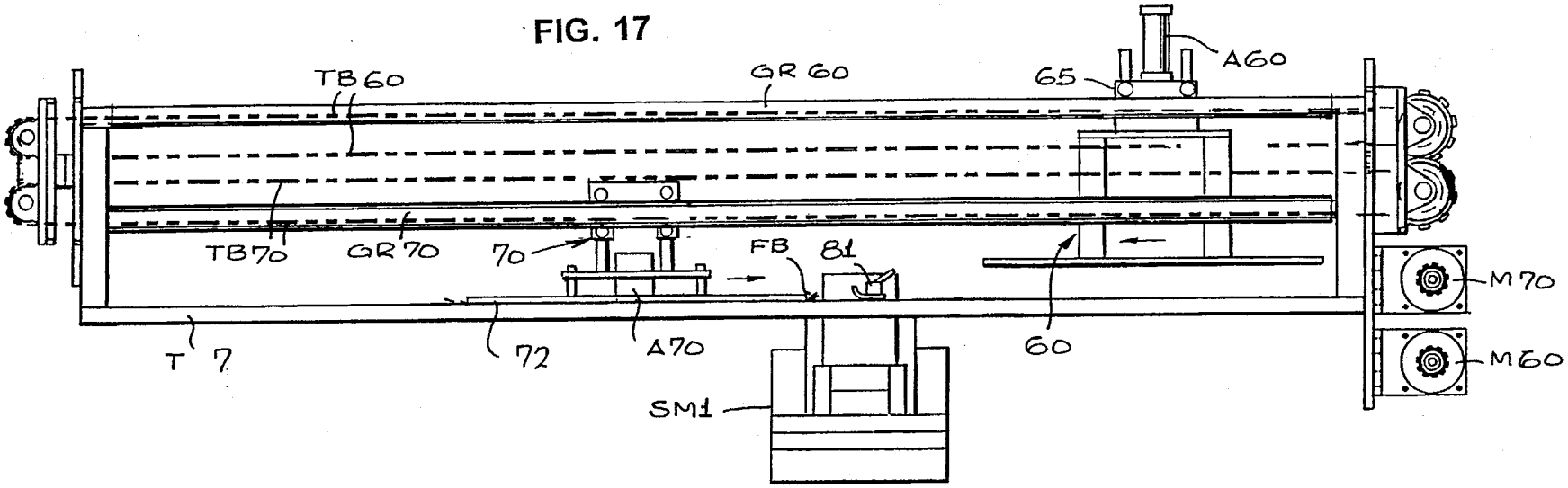
FIG. 17 is a side elevational view of the carriages transport mechanisms of FIGS. 1, 14–17.

FIG. 14 shows first sewing carriage assembly 60 holding bag blank FB for sewing by sewing machine SM1 and second sewing carriage assembly 70 in its upward position. FIGS. 15 and 16 show the sewing carriage assemblies 60 and 70 in perspective with their actuators A60 and A70 for upward retraction, clearly shown. In FIGS. 14 and 15, the holddown arm 72 also is retractable by a retraction actuator RA70 toward holddown arm 71 while it is moving, retracted upward, to provide clearance while passing under the carriage 60. When carrying a folded bag blank FB, the holddown arm 72 is in its extended position as shown in FIGS. 13 and 17. Thus both carriages 60 and 70 have their arm 62 or 72 adjacent to the presser foot 81 of the sewing head SM1 at approximately the same distance to keep the bag blank under the presser foot 81 of the sewing machine SM1 while the bag blank FB is being transported through the sewing machine. As an alternative, either carriage 60 or 70 may include a pivot for its holddown 62 or 72 for noninterference during each passage. Since the arm 62 is transporting folded bag FB during its movement as shown in FIG. 14, a change of position of the arm 62 is not appropriate. The carriage 70 is not transporting any bag in FIG. 14, its holddown 72 is retracted and both holddown feet 71 and 72 are lifted.

The transport mechanisms 65 and 75 for the carriages 60 and 70, respectfully are shown in FIGS. 12 and 17 with the carriage 70 traveling toward the first sewing machine head SM1 with a folded bag blank FB under its holddown 72 and with the carriage 60 traveling in the opposite direction to pick up the next folded bag blank FB.

THE SECOND STAGE TRANSPORT AND SEWING SUBASSEMBLY

Figure 18:
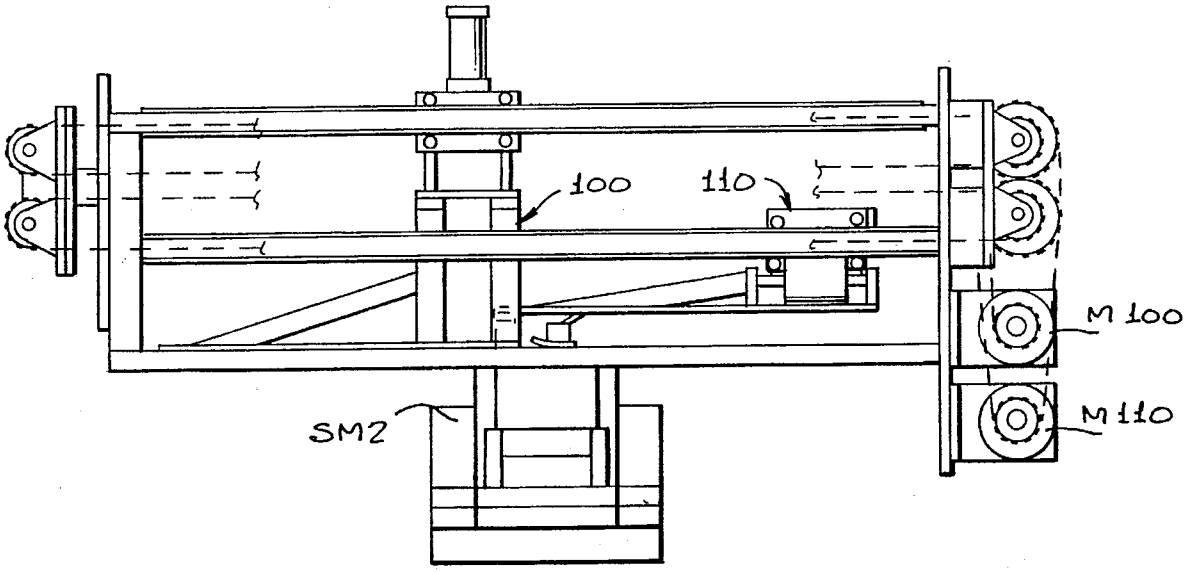
FIG. 18 is a side elevational view of the second seam sewing and transfer subassemblies of the machine of FIG. 1.
Figure 19:
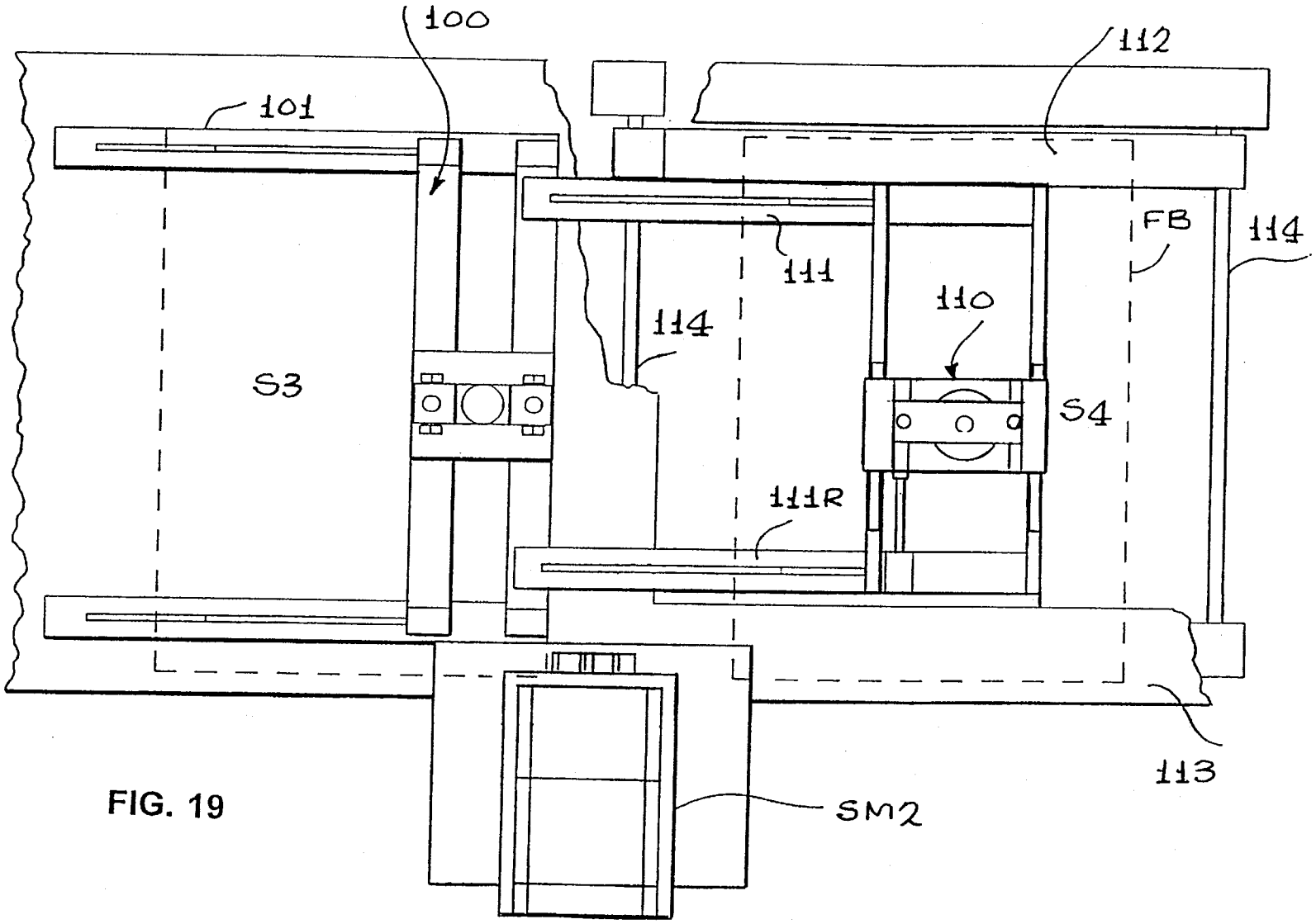
FIG. 19 is a top plan view of the second seam sewing and transfer subassemblies and the elevator or stacker assembly of this invention.
Figure 19A:
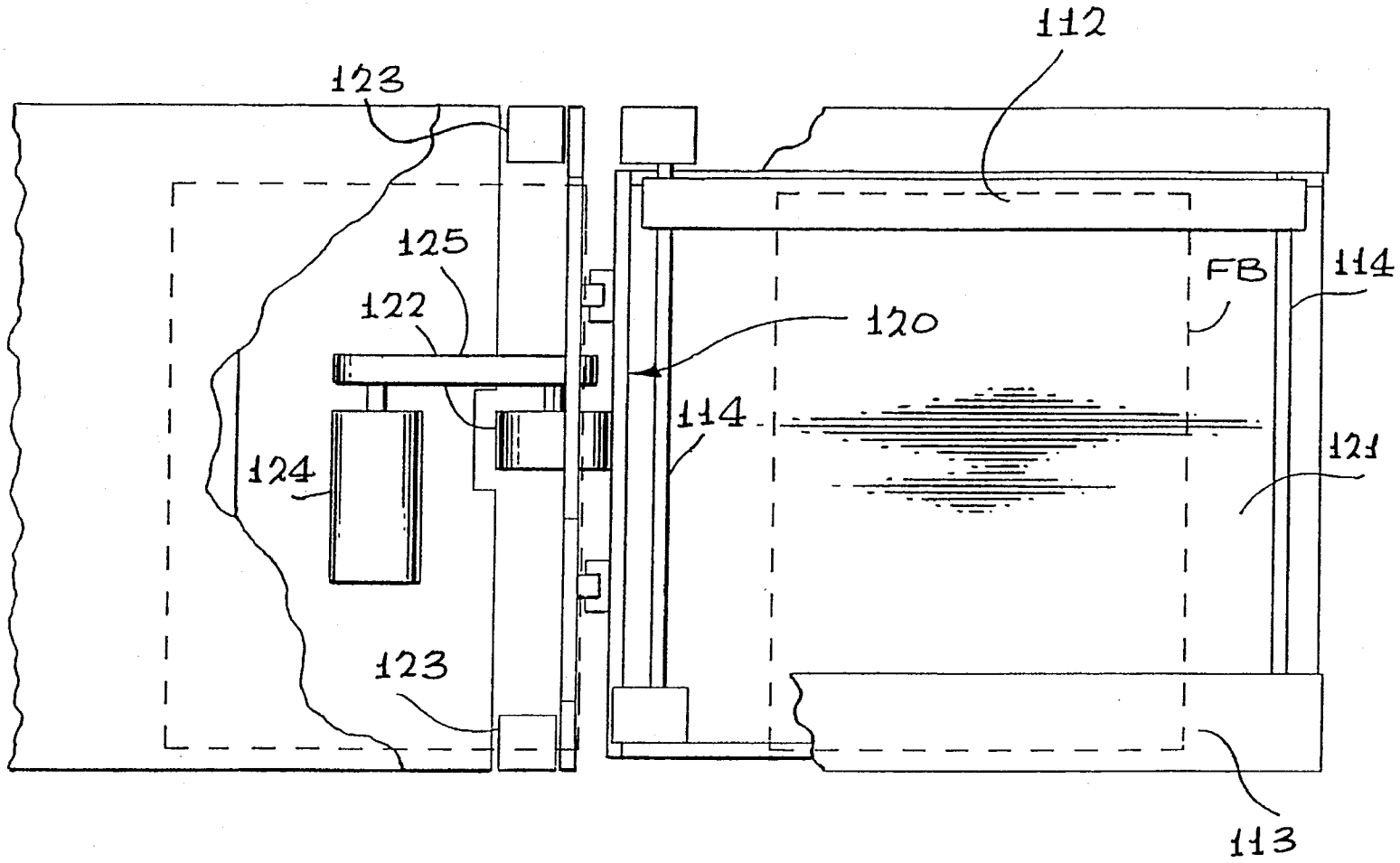
FIG. 19*a* is a top plan view of the elevator or stacker with portions broken away for clarity.
Figure 20A:
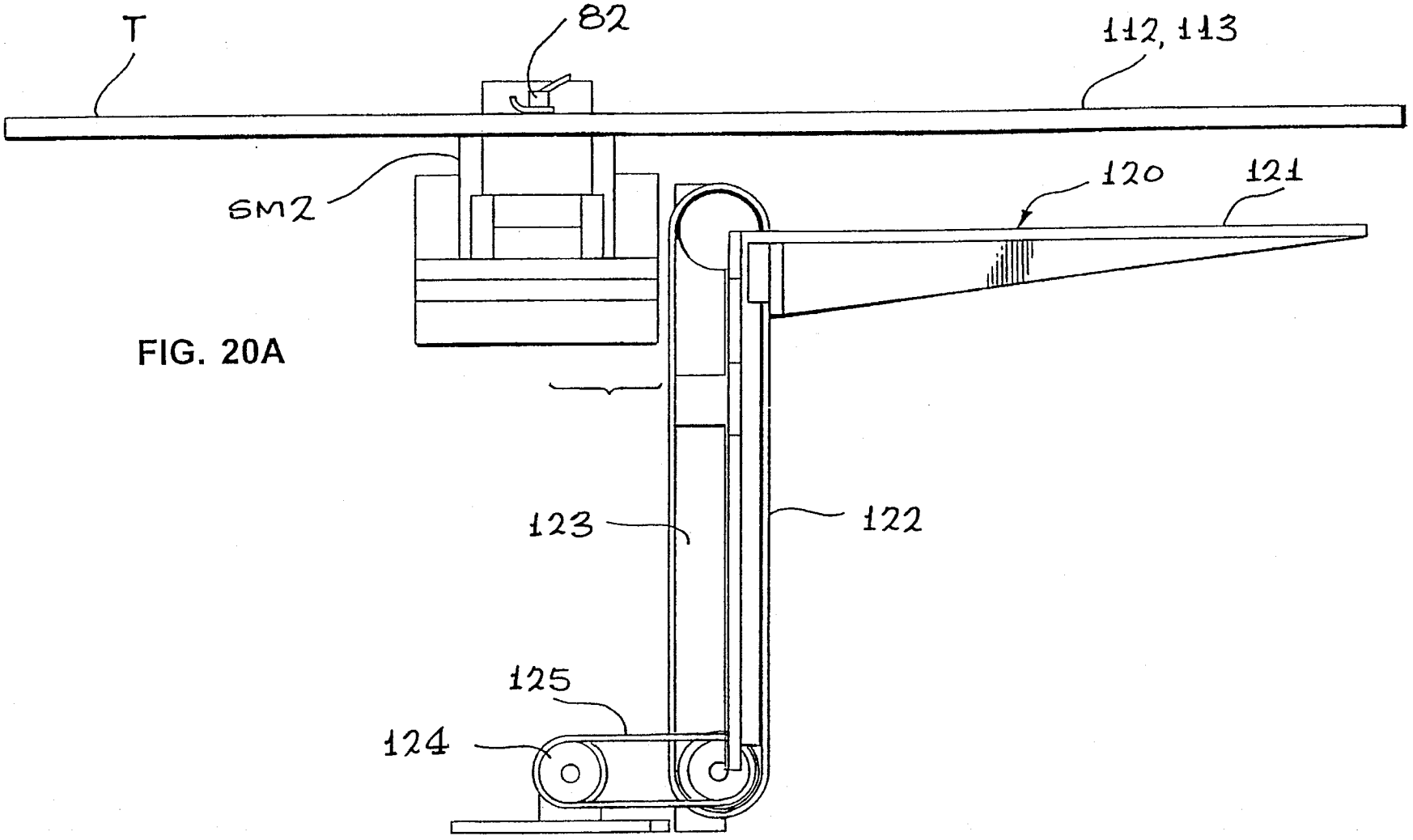
FIG. 20*a* is an enlarged side elevational view of the finished bag elevator or stacker with the table, the second stage sewing machine and finished bag support rails.

After sewing the first seam, each partially sewn bag blank, now designated FBS1, being folded and one seam sewn, is deposited at position "S2" of FIG. 2 ready for transport for the second seam sewing by sewing machine SM2 of FIGS. 1, 18 and 19. In this case, a third sewing carriage assembly 100 is employed with its retractable holddown 101 which is elevated on its return trip to the left in FIGS. 1 and 19 and resting on a single seamed bag blank FBS1 on the table T.

Typically, the third sewing carriage assembly 100 and the second sewing machine SM2 are used to sew a shorter seam so only one carriage is needed, but it operates at twice the speed of the carriages 60 and 70. In any event the speeds of the carriages are determined by the bag material and dimensions for optimum sewing speed.

The second stage sewing section begins with the transfer carriage 110 of FIG. 19 moving to the far left (position 2) and clamping down on the sewn edge of bag blank FBS1 with arms 111 and 111R. Then the transfer carriage 110 pulls the bag blank FBS1 to position S3 of FIG. 19 and stops about two inches before the pressor foot 82 of sewing machine SM2.

As the transfer carriage 110 is moving to position S3, drag brush #2 moves down the contact bag blank FBS1 which keeps the bag blank pressed down and straight. Once the transfer carriage 110 reaches position S3, it stops, raises and the second seam is sewn then moves back to position S2 to pick up another bag blank.

Next, the third sewing carriage 100 clamps down onto the bag blank at S3 and begins to travel through sewing machine SM2 to position S4. Once the sewing carriage reaches position S4, it raises up and allows the finished sewn bag to drop between the guide rails 112 and 113 and land on a stack of bags that are resting on the platform 121 of stacker elevator 120 of FIGS. 17 through 21. The elevator 120 includes a platform 121, a vertical drive belt 122 on a frame 123 all driven by a stepper motor 124 through primary drive belt 125. The elevator 120 is stepped down one increment for each bag produced until the elevator is full at which time the operator removes the stack of finished bags. Each bag falls off of the rails 112 and 113.

The only operator involvement is to load a roll of bag material on mandrel 21, set the parameters of bag size and sewing rate and remove finished bags.

Figure 23:
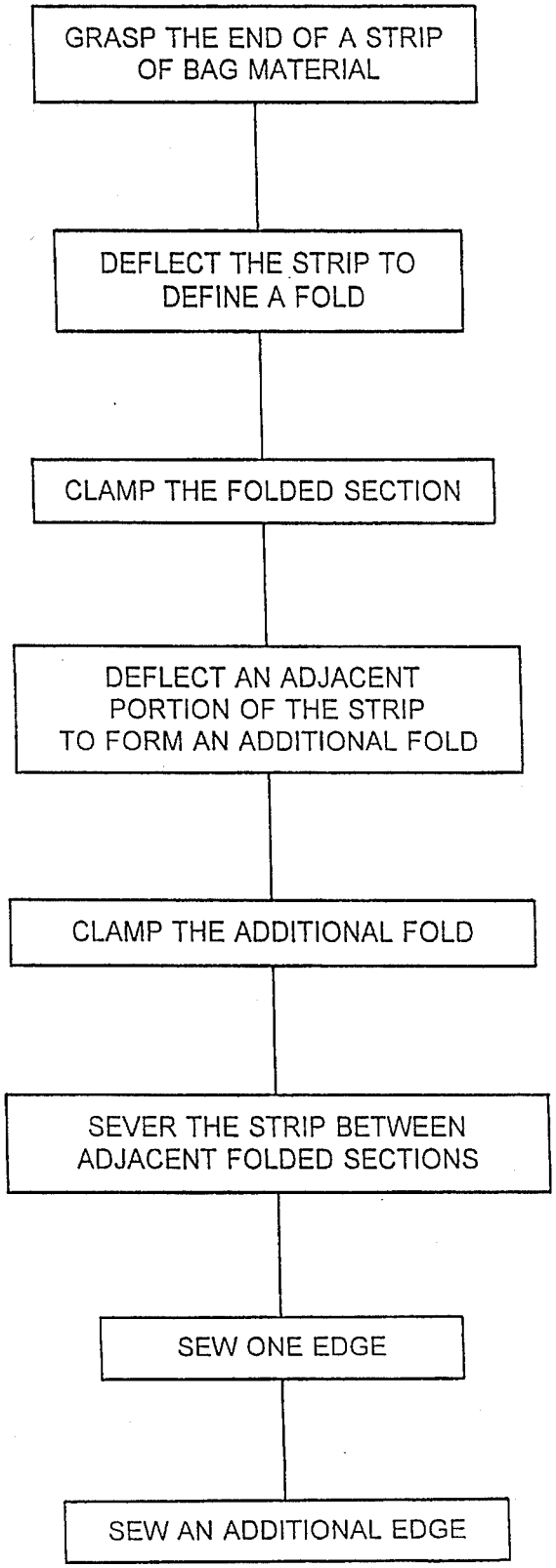
FIG. 23 is a flow diagram for the process of this invention.

The control of this machine is preferably be computer but may be accomplished by timers, either electronic or mechanical which are set to carry out the process shown in FIG. 23.

MACHINE OPERATION SUMMARY

The operation of machine 10 may be summarized by the following steps in completing a bag making cycle with the end of the strip of bag material manually secured in a clamp 34 which is located between clamps 34A at the first fold operation and clamp 34B at the cutting operation:

FOLDING AND CUTTING SUBASSEMBLY 11

1. Open clamps 34A and 34C;
2. Advance blade 33 into loading station LS to make a fold FB at 34A; and Activate cutter 40 to sever any bag blanks at 34B;
3. Close clamp 34A; and Withdraw blade 33;
4. Rotate drum 25 by one increment and stop;
5. Open clamps 34A and 34C.

FIRST STAGE TRANSPORT AND SEWING ASSEMBLY

1. Advance extractor clamp 46 over cut edge E/E of folded cut bag blank FB at clamp 34C;
2. Lower clamp arm 47 to grasp bag blank FB at edges E/E;
3. Retract extractor clamp 46 and bag blank FB on table T at position S1; and Lower drag brush DB to flatten and straighten the folded cut bag blank;
4. Raise clamp arm 47; and Raise drag brush DB;
5. Advance carriage 60 to position S1; and Retract carriage 70 to position S2;
6. Lower holdown arms 61 and 62 to grasp the bag blank at side edge regions with cut edge E/E exposed to sewing machine head SM1 and ready to pass under the presser foot 81;
7. Advance carriage 60 with bag blank FB through sewing station SM1 to position S2; and Return carriage 70 to position S1 passing under carriage 60 with holdown arm 72 retracted inwardly toward arm 71;
8. Raise carriage 60 arms 61 and 62 to release single sewn bag blank FBS1; and Extend holdown arm 72 toward the sewing machine SM1 and lower carriage 70 arms 71 and 72 over next bag blank FB;
9. Advance carriage 70 with bag blank FB through sewing station SM1 to position S2; and Return carriage 60 to position S1 passing over carriage 70.

SECOND SEWING STAGE SUBASSEMBLY

1. Advance transfer carriage 110 to the sewn edge of position S2;
2. Lower transfer carriage 110 to grasp single sewn bag blank;
3. Retract transfer carriage 110 to the proximity of the second sewing machine SM2 with the unsewn edge of the bag blank FBS1 just before the presser foot 81 of sewing machine SM2; and Lower drag brush DB2 during transfer operation to straighten and flatten single sewn bag blank FBS1;
4. Advance transfer carriage 110 to sewn edge of position S2 to pickup next single sewn bag blank FBS1; and Advance third sewing carriage assembly 100 through sewing machine SM2 to sew the second edge of the single sewn bag blank and deposit fully sewn bag FBS2 at position S4; and
5. Raise and return third sewing carriage assembly 100 to position S3.

FINISHED BAG ELEVATOR AND STACKER

1. Lower elevator platform by one increment with each operation 5 of the second sewing stage 13.

THE PROCESS OF THIS INVENTION

Bags are formed in the machine 10 by a process which is unique in the bag making industry and as a result provides lower cost and faster throughput of high quality bags. The process is carried out with flat single layer material, not tubular material, which is unrolled and grasped at its end, preferably across its whole width.

Next, a portion between the grasped end and the roll is forced into open jaws to produce a fold of depth approximating the width of the finished bag. Next, the entrance portion of the folded material is grasped, and the fold while retained in closed jaws or other holding device is transferred a sufficient distance to allow a next fold to be formed. The holding device just closed about the folded section serves to tension the bag material while the folding operation is again performed on an adjacent length of bag material. The fold material comes from the dancer bar and roll since its discharged end is tensioned by the grasping operation. This process is repeated again and again.

After each fold is formed and after it completes its tensioning operation, the bag material is cut between adjacent holding means to produce folded cut bag blanks which are grasped by the cut edges. Next, the folded bag blanks are released and transferred past a sewing station which sews the cut edges of the roll material. The folded, cut, single sewn bag blank is next transferred to a second sewing operation which sews one of the remaining edges of the bag blank, leaving one edge unsewn to act as the bag opening. These steps are shown in the sequence diagram of FIG. 23.

We have found the following to be the best components for carrying out this invention:

| SEWING MACHINE | MANUFACTURER | MODEL |
|---|---|---|
| SM1 and SM2 | Rimoldi (of Italy) | Vega |

Sewing machines SM1 and SM2 each include thread cutters which sever the thread a few stitches after each bag passes. The sewing machine or stitch selected will depend upon the user's choice. Either an overlock stitch or a straight single needle stitch are commonly used. Both are well known in the art.

| ACTUATOR | MANUFACTURER | TYPE |
|---|---|---|
| 32 | BIMBA OR A SERVO MOTOR ACTUATOR | PNEUMATIC |
| 45 | ORIGA | RODLESS CYLINDER |
| 50, 53, 55 | BIMBA | PNEUMATIC CYLINDER |
| 48a | ORIGA | RODLESS CYLINDER |
| ALL OTHER ACTUATORS | BIMBA OR COMPARABLE | PNEUMATIC CYLINDERS |
| **MOTORS** | **MANUFACTURER** | **MODEL** |
| 22a | BODINE | GEAR MOTOR |
| M60 | Mitsubishi | Mel Servo 40J |
| M70 | Mitsubishi | Mel Servo 40J |
| M100 | Mitsubishi | Mel Servo 40J |
| M110 | Mitsubishi | Mel Servo 40J |
| 124 | BODINE | GEAR MOTOR |

The above described embodiments of the present invention are merely descriptive of its principles and are not to be considered limiting. The scope of the present invention instead shall be determined from the scope of the following claims including their equivalents.

What is claimed is:

1. A bag making machine for producing an open ended bag from a strip of bag material comprising;

supply means including a roll mandrel and means for supplying bag blank material;

means for forming successive folds of the bag blank material to define generally the finished bag size including one folded edge, an opening and two edges to be sewn;

means for successively cutting across the width of the bag blank material to define one edge of each bag blank;

means for transferring each successive folded bag blank from the cutting means to a sewing station;

a sewing head positioned along the first unsewn edge of each folded bag blank;

a pair of reciprocating carriages, one positioned at the sewing station before the sewing head and the second reciprocating carriage positioned beyond the sewing head;

means for actuating said reciprocating carriages to opposite positions with respect to said sewing head with the first reciprocating carriage carrying a bag blank and said second reciprocating carriage in a non-bag carrying condition whereby said first reciprocating carriage transports the bag blank through said sewing head to sew a first seam on said bag blank and said second reciprocating carriage is in position to receive the next bag blank for sewing of its first seam;

a third reciprocating carriage positioned for travel at a right angle with respect to the travel of said first and second reciprocating carriages;

means for grasping a bag blank after the sewing of the first seam after one of said first and second reciprocating carriages has transported a bag blank through said first sewing head;

a second sewing head; and said third carriage transporting the folded, single seam sewn bag blank through said second sewing head to allow sewing of a second seam of the bag blank.

2. The machine in accordance with claim 1 wherein said first and second carriages are positioned on said machine to traverse the same longitudinal path through the first sewing head with at least one of said carriages at least partly retracting to avoid interference with the other reciprocating carriage during passage.

3. The machine in accordance with claim 2 wherein said first and second reciprocating carriages include pressure applying surfaces to the bag blank at substantially the same distance from the sewing head to insure uniform seam sewing quality.

4. The machine in accordance with claim 1 wherein said folding and cutting means including a drum mounting a plurality of clamps with jaws opening at the periphery to receive folds of the bag blank material.

5. The machine in accordance with claim 1 wherein said folding means includes reciprocating blade means for producing a fold of the bag blank material.

6. The machine in accordance with claim 5 wherein said blade defining the approximate dimensions of the finished bag whereby one reciprocation of the blade produces a fold in the bag blank approximating the size of the finished bag.

7. In a bag making machine for producing a bag from a continuous strip of bag material, folding and cutting apparatus comprising:

a circular array of clamp members each including a pair of openable jaws and including a material receiving opening extending generally radially inwardly from said jaws at a peripheral position on said circular array, the radial distance from the jaws of said clamp members being at least as great as one dimension of the intended bag;

means for holding the end of a strip of bag making material across the jaws of one of said clamp members;

means for advancing the strip of bag making material from a supply to said holding means, the route of advance of the strip of bag making material being over the jaws of one of said clamp members;

extensible means positioned for entrance into one of said clamp members to drive a fold of material into the jaws of said clamp member and to withdraw from said clamp member leaving a fold of material which defines at least one of the dimensions of the desired finished bag; and means for advancing said clamp and folded material to a later peripheral position for further processing of the folded bag material.

8. A bag making machine in accordance with claim 7 wherein said clamp members are positioned on the periphery of a rotatable drum.

9. A bag making machine in accordance with claim 7 wherein said extensible means comprises a blade.

10. A bag making machine in accordance with claim 9 wherein said extensible means includes means for reciprocally moving said blade in and out of the jaws of a clamp member to form a folded bag blank.

11. A bag making machine in accordance with claim 10 wherein said extensible means include means mounting said blade for radial movement with respect to said circular array of clamp members.

12. A bag making machine in accordance with claim 7 including means for rotating said circular array about the axis of said array to a series of discrete radial positions.

13. A bag making machine in accordance with claim 12 wherein at least one of said clamp members located in the direction of rotation of the circular array beyond said extensible means is closed and holds a fold of bag material and wherein a portion of the strip of material extends between said one of said clamp members and the next adjacent clamp member in the direction opposite of the direction of advance of said circular array; and cutting means movable to cut the bag material said extending material between adjacent clamp members.

14. A bag making machine in accordance with claim 13 including means for opening the jaws of a clamp member following said cutting means; and means for drawing said cut bag material from the jaws of said clamp member while retaining the material in folded condition.

15. A process for making bags from a strip of bag material comprising the steps of:

grasping the end of the strip of material;

deflecting the strip to form a fold approximating the size of the finished bag;

clamping the folded portions;

deflecting the strip to form a next fold;

clamping the folded portion;

cutting the strip between the folded portions to form individual bag blanks;

advancing each folded individual bag blank to a first sewing station;

sewing one edge of the bag blank;

advancing each folded individual bag blank to a second sewing station; and sewing another edge of the bag blank to produce a bag.

16. The process in accordance with claim 15 wherein said deflecting step is performed by pressing the material into a jaw-like recess.

17. The process in accordance with claim 16 wherein said clamping step is performed by closing the recess.

18. The process in accordance with claim 15 wherein the clamping steps produce a tensioned portion of the material between adjacent folds.

19. The process in accordance with claim 18 wherein adjacent folds are severed at said tensioned portion.

20. The process in accordance with claim 15 wherein said folding steps are performed sequentially while advancing the folds in a generally circular path.

21. The process in accordance with claim 20 wherein the folds advancing in the circular path traverses a cutting station in which adjacent folds are separating by cutting.

22. The process in accordance with claim 15 wherein the sewing of one edge is performed with the material traveling at a 90 degree angle with respect to the direction of travel in the folding and cutting steps.

23. The process in accordance with claim 15 wherein the sewing of the additional edge is performed while the material is traveling in a direction at 90 degrees with respect to the direction of travel during said first edge sewing step.

24. A bag making machine for producing an open ended bag from a strip of bag material comprising:

supply means including a roll mandrel and means for supplying bag blank material;

means for forming successive folds of the bag blank material including a circular array of clamp members each including a pair of openable jaws and including a material receiving opening extending generally radially inwardly from said jaws at a peripheral position on said circular array, the radial distance from the jaws of said clamp members being at least as great as one dimension of the intended bag;

means for holding the end of the strip of bag making material across the jaws of one of said clamp members;

means for advancing the strip of bag making material from the supply to said holding means, the route of advance of the strip of bag making material being over the jaws of one of said clamp members;

extensible means positioned for entrance into one of said clamp members to drive a fold of material into the jaws of said clamp member and to withdraw from said clamp member leaving a fold of material which defines at least one of the dimensions of the desired finished bag;

means for advancing said clamp and folded material to a later peripheral position for further processing of the folded bag material;

means for successively cutting across the width of the bag blank material to define one edge of each bag blank;

means for transferring each successive folded bag blank from the cutting means to a sewing station;

a sewing head positioned along the first unsewn edge of each folded bag blank;

a pair of reciprocating carriages, one positioned at the sewing station before the sewing head and the second reciprocating carriage positioned beyond the sewing head;

means for actuating said reciprocating carriages to opposite positions with respect to said sewing head with the first reciprocating carriage in a non-bag carrying condition whereby said first reciprocating carriage transports the bag blank through said sewing head to sew a first seam on said bag blank and said second reciprocating carriage is in position to receive the next bag blank for sewing of its first seam;

third reciprocating carriage positioned for travel at a right angle with respect to the travel of said first and second reciprocal carriages;

means for grasping a bag blank after the sewing of the first seam after one of said first and second reciprocating carriages has transported a bag blank through said first sewing head;

a second sewing head; and said third carriage transporting the folded, single seam sewn bag blank through said second sewing head to allow sewing of a second seam of the bag blank.

25. A process for making bags with a rotary folding mechanism having a plurality of jaw-like recesses, said bags being formed from a strip of bag material, comprising the steps of:

a) grasping the end of the strip of material;

b) deflecting the strip into one of said jaw-like recesses to form a fold approximating the size of the finished bag;

c) clamping the folded portion;

d) indexing said folding mechanism to a second position;

e) deflecting the strip into a second jaw-like recess to form a second fold;

f) clamping the folded portion;

g) cutting the strip between the folded portions to form individual bag blanks;

h) indexing said folding mechanism to a plurality of successive positions, each time deflecting said strip into a successive jaw-like recess and cutting the strip between folded portions to form another bag blank;

i) advancing each individual folded bag blank to a first sewing station;

j) sewing one edge of the bag blank;

k) advancing each folded individual bag blank to a second sewing station; and l) sewing another edge of the bag blank to produce a bag.

* * * * *